US008649723B2

(12) United States Patent
Hasegawa et al.

(10) Patent No.: US 8,649,723 B2
(45) Date of Patent: Feb. 11, 2014

(54) PROTECTIVE AGENT FEEDING MEMBER, PROTECTIVE LAYER FORMING APPARATUS, AND IMAGE FORMING APPARATUS

(75) Inventors: Kunio Hasegawa, Kanagawa (JP); Hiroshi Nakai, Kanagawa (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 13/358,890

(22) Filed: Jan. 26, 2012

(65) Prior Publication Data

US 2012/0195662 A1 Aug. 2, 2012

(30) Foreign Application Priority Data

Feb. 2, 2011 (JP) ..... 2011-021081
Aug. 4, 2011 (JP) ..... 2011-170806

(51) Int. Cl.
*G03G 21/00* (2006.01)

(52) U.S. Cl.
USPC ..... 399/346

(58) Field of Classification Search
USPC ..... 399/346, 349, 350
See application file for complete search history.

(56) References Cited

U.S. PATENT DOCUMENTS

| | | | | |
|---|---|---|---|---|
| 3,501,294 | A | 3/1970 | Joseph | |
| 7,653,339 | B2 | 1/2010 | Yamashita et al. | |
| 7,941,087 | B2 | 5/2011 | Tanaka et al. | |
| 7,970,334 | B2 | 6/2011 | Yamashita et al. | |
| 7,979,017 | B2 | 7/2011 | Tanaka et al. | |
| 7,991,342 | B2 | 8/2011 | Kabata et al. | |
| 8,219,017 | B2 * | 7/2012 | Nakai et al. | 399/346 |
| 8,494,404 | B2 * | 7/2013 | Takagi et al. | 399/100 |
| 2009/0196665 | A1 | 8/2009 | Tanaka et al. | |
| 2009/0285613 | A1 | 11/2009 | Nakai et al. | |
| 2009/0290920 | A1 | 11/2009 | Hatakeyama et al. | |
| 2009/0304423 | A1 | 12/2009 | Ozaki et al. | |
| 2010/0034560 | A1 | 2/2010 | Tanaka et al. | |
| 2010/0054829 | A1 | 3/2010 | Iio et al. | |
| 2010/0183972 | A1 | 7/2010 | Hasegawa et al. | |
| 2010/0189452 | A1 | 7/2010 | Tanaka et al. | |
| 2010/0209143 | A1 | 8/2010 | Nakai et al. | |
| 2010/0239309 | A1 | 9/2010 | Tanaka et al. | |
| 2010/0310291 | A1 | 12/2010 | Tanaka et al. | |
| 2011/0008088 | A1 | 1/2011 | Nakai et al. | |
| 2011/0038656 | A1 | 2/2011 | Hasegawa et al. | |
| 2011/0052286 | A1 | 3/2011 | Urayama et al. | |

FOREIGN PATENT DOCUMENTS

| | | |
|---|---|---|
| JP | 51-22380 | 7/1976 |
| JP | 2006-350240 | 12/2006 |
| JP | 2007-65100 | 3/2007 |
| JP | 2007-293240 | 11/2007 |
| JP | 2008-158427 | 7/2008 |
| JP | 2009-150986 | 7/2009 |
| JP | 2010-169818 | 8/2010 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

There is provided a protective agent feeding member, which contains a core and a foam layer provided on an outer periphery of the core, in which the protective agent feeding member is in the shape of a roller, and the foam layer has a roughened surface and has a maximum height Ry of 400 μm to 1,630 μm.

10 Claims, 7 Drawing Sheets

PROTECTIVE AGENT FEEDING MEMBER, PROTECTIVE LAYER FORMING APPARATUS, AND IMAGE FORMING APPARATUS

BACKGROUND OF THE INVENTION

1. Field of the Invention

The present invention relates to a protective agent feeding member, a protective layer forming apparatus using the protective agent feeding member, and an image forming apparatus containing the protective layer forming apparatus.

2. Description of the Related Art

In conventional electrophotographic image formation, a visible image is formed by forming a latent image of electrostatic charges on an image bearing member of a photoconductive substance (referred to also as "latent electrostatic image bearing member," "electrophotographic photoconductor," or "photoconductor"), and adhering charged toner particles to the latent electrostatic image. The visible image formed by the toner is finally transferred onto a recording medium such as paper and is fixed on the recording medium, for example, by heat, pressure, a solvent, or gas to form an output image.

Electrophotographic image forming methods are roughly classified according to toner particle charging methods for visualization into the so-called two-component development method using tribocharging by stirring or mixing of toner particles and carrier particles and the so-called one-component development method in which charges are applied to toner particles without the use of carrier particles. The one-component development method is more advantageous in space saving and cost reduction than the two-component development method. Accordingly, the one-component development method is mainly used in small printers, facsimile machines and the like.

In these electrophotographic image forming apparatuses, a method is adopted that contains uniformly performing charging while rotating an image bearing member generally having a drum or belt shape regardless of a development method, forming a latent image pattern by laser beams or the like on the image bearing member, visualizing the latent image pattern by a developing unit, and further transferring the visualized image onto a recording medium.

A toner component that remains untransferred stays on the image bearing member after the transfer of the visible image on the recording medium. When the residual toner component is conveyed as it is without being processed to thereby perform a charging step, even charging of the image bearing member is sometimes hindered. Accordingly, a method is generally adopted in which, after the transferring step, the toner component and the like that stay on the image bearing member are removed by a cleaning step to satisfactorily clean the surface of the image bearing member, followed by charging.

In recent years, due to a reduction in size and a reduction in cost of electrophotographic image forming apparatuses, a contact charging method and a proximity charging method are mainly used in the charging step in the image formation. It is, however, difficult to evenly electrify the surface of the image bearing member due to, for example, a slight unevenness of the contact between the charging unit and the surface of the image bearing member and a variation in gap between the charging unit and the surface of the image bearing member. For this reason, an AC superimposed charging method has been used, and in this method an alternating current AC component is superimposed on a direct current DC component.

The proximity charging method by the AC superimposed charging can realize a reduction in size of a device and an improvement in image quality and, at the same time, renders the charging unit and the image bearing member non-contact while maintaining even charging. Thus, deterioration in the charging unit can be suppressed.

When the image bearing member is an organic photoconductor (OPC), the energy of the AC superimposed charging, however, cuts molecular chains of the resin forming the surface of the image bearing member, resulting in lowered mechanical strength that leads to remarkably progressed abrasion of the image bearing member. Further, since the AC superimposed charging activates the surface of the image bearing member, a problem occurs that the adhesion between the surface of the image bearing member and the toner increases and, thus, the capability of the image bearing member to be cleaned is lowered.

On the other hand, a recent tendency towards color output images has led to the development of toners that have smaller particle diameters and are circular, for improved image quality and image quality stabilization purposes. This tendency poses an increasing problem of cleaning in the electrophotographic image formation method. In order to remove the residual toner by cleaning, it is necessary to apply a higher rubbing force of the cleaning unit against the image bearing member than the force applied in the conventional technique. Accordingly, there is a problem of remarkable abrasion of the image bearing member, the cleaning unit and the like.

In each step for the electrophotographic image formation, electrical stress and physical stress exist. The image bearing member that has undergone these stresses causes a change in the surface state with the elapse of time.

Coating a protective agent on the image bearing member is known to be effective for solving the above problems. Examples of proposals for coating include one in which a block-shaped protective agent formed mainly of zinc stearate, a so-called protective agent block, is coated on an image bearing member (see Japanese Patent Application Publication (JP-B) No. 51-22380) and one in which a protective agent block prepared by adding boron nitride to a protective agent block formed mainly of zinc stearate is coated on an image bearing member (see Japanese Patent Application Laid-Open (JP-A) No. 2006-350240).

Coating the protective agent block onto the image bearing member lowers a coefficient of friction on an image bearing member to reduce a deterioration in a cleaning blade or an image bearing member and to improve the separation of an adhered material such as an untransferred toner adhered on the image bearing member. As a result, a failure of cleaning and occurrence of filming with the elapse of time can be suppressed.

Further, regarding a technique for coating a protective agent block onto the image bearing member, a proposal has been made on a protective layer forming apparatus containing: a protective agent block; a protective agent feeding member formed of a brush-shaped rotary member that is brought into contact with the protective agent block and coats the protective agent, which has been adhered on the surface, onto an image bearing member; and a protective agent pressing member that presses the protective agent block to allow the protective agent block to be brought into contact with the protective agent feeding member (see JP-A No. 2007-65100 and JP-A No. 2007-293240).

In these proposed techniques, however, a large amount of a protective agent powder produced from the protective agent block by rubbing with the brash-shaped rotary member, and is blown into the air by the rotation of the brush-shaped rotary member. Therefore, this poses a problem that a large amount of the protective agent is wasted. Further, the above techniques are disadvantageous in that bristle inclination or deterioration of brush fibers occurs with the elapse of time, the consumption of the protective agent is not stable, and the protective agent cannot be fed at a given amount over a long period of time.

Therefore, a technique has been proposed in which a roller-shaped protective agent feeding member containing a foam layer is used as a protective agent feeding member in a protective layer forming apparatus (Japanese Patent Application Laid-Open (JP-A) No. 2009-150986). According to this proposal, flying of the protective agent powder by rubbing hardly occurs.

In this proposed technique, however, the roller-shaped protective agent feeding member containing the foam layer is so soft that the force that shaves the protective agent block is small. Therefore, the protective agent cannot be satisfactorily fed to the image bearing member, and it is difficult to satisfactorily suppress filming of the image bearing member. Further, an attempt to press the protective agent block at a high pressure to increase the amount of the protective agent block shaved by the protective agent feeding member causes the application of a large load to the protective agent block and makes it impossible to evenly shave the protective agent block in a longitudinal direction. Consequently, the amount of the protective agent fed in a longitudinal direction of the protective agent block is disadvantageously varied. As a result, at a site in an image bearing member where the amount of the protective agent fed is small, the protective effect by the protective agent cannot be attained and filming occurs.

Accordingly, at the present time, there is a demand for the provision of a roller-shaped protective agent feeding member containing a foam layer that is substantially free from flying of a protective agent powder by rubbing, eliminates the need to increase the consumption of the protective agent, and can prevent filming, a protective layer forming apparatus using the protective agent feeding member, and an image forming apparatus containing the protective layer forming apparatus.

BRIEF SUMMARY OF THE INVENTION

An object of the present invention is to provide a protective agent feeding member containing a foam layer that is substantially free from flying of the protective agent powder by rubbing, eliminates the need to increase the consumption of the protective agent, and can prevent filming, and also to provide a protective layer forming apparatus using the protective agent feeding member, and an image forming apparatus containing the protective layer forming apparatus.

Means for solving the above problems are as follows.

Specifically, one aspect of the present invention includes a protective agent feeding member, which contains: a core; and a foam layer provided on an outer periphery of the core, wherein the protective agent feeding member is in the shape of a roller, and wherein the foam layer has a roughened surface and has a maximum height Ry of 400 μm to 1,630 μm.

Another aspect of the present invention includes a protective layer forming apparatus, which contains: a protective agent block; and a protective agent feeding member, wherein the protective agent feeding member contains: a core; and a foam layer provided on an outer periphery of the core, where the protective agent feeding member is in the shape of a roller, and the foam layer has a roughened surface and has a maximum height Ry of 400 μm to 1,630 μm.

Yet another aspect of the present invention include image forming apparatus, which contains: an image bearing member; a charging unit configured to charge a surface of the image bearing member; an exposure unit configured to expose the charged surface of the image bearing member to light to form a latent electrostatic image; a developing unit configured to develop the latent electrostatic image with a toner to form a visible image; a transferring unit configured to transfer the formed visible image onto a recording medium; a fixing unit configured to fix the transferred image onto the recording medium; a cleaning unit configured to remove the residual toner on the surface of the image bearing member; and a protective layer forming unit configured to apply a protective agent on the surface of the image bearing member to form a protective layer, wherein the protective layer forming unit contains: a protective agent block; and a protective agent feeding member, wherein the protective agent feeding member contains: a core; and a foam layer provided on an outer periphery of the core, where the protective agent feeding member is in the shape of a roller, and the foam layer has a roughened surface and has a maximum height Ry of 400 μm to 1,630 μm.

The present invention can solve the above-described various problems and can provide a roller-shaped protective agent feeding member containing a foam layer that is substantially free from flying of the protective agent powder by rubbing, eliminates the need to increase the consumption of the protective agent, and can prevent filming, a protective layer forming apparatus using the protective agent feeding member, and an image forming apparatus containing the protective layer forming apparatus.

DETAILED DESCRIPTION OF THE INVENTION (Protective Agent Feeding Member)

The protective agent feeding member according to the present invention contains at least a core, a foam layer and if necessary additional other parts.

The protective agent feeding member is in a roller form.

<Core>

The material, shape, size, and structure of the core are not particularly limited and may be properly selected according to purposes.

Materials for the core include, for example, resins and metals. Examples of such resins include epoxy resins and phenolic resins. Examples of such metals include iron, aluminum, and stainless steel.

Examples of the shape of the core include a columnar shape and a cylindrical shape.

<Foam Layer>

The foam layer is formed on the outer periphery of the core.

Figure 1A:
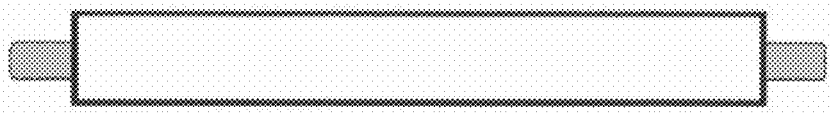
FIGS. 1A to 1C are schematic front views illustrating examples of a protective agent feeding member according to the present invention.
Figure 1B:
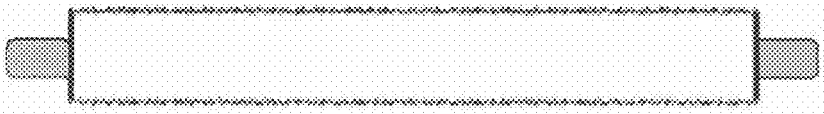
Figure 1C:
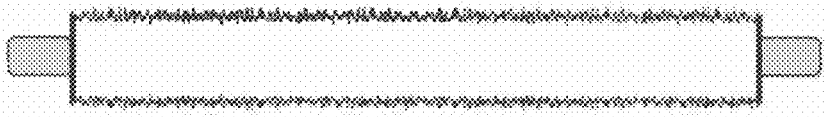

The foam layer has a roughened surface. For example, convexes are irregularly formed on the surface of the foam layer by the surface roughening (see FIGS. 1A to 1C). Note that, FIG. 1A illustrates the state where no convexe is formed on the surface of the foam layer, FIG. 1B illustrates the state where small convexes are irregularly formed on the surface of the foam layer, and FIG. 1C illustrates the state where large convexes are irregularly formed on the surface of the foam layer.

Here irregular arrangement of convexes means that convexes are not regularly arranged, for example, that at least any one of pitch and height (depth) is not fixed.

At a site (a nip portion) where the protective agent feeding member is abutted against the image bearing member, a phenomenon that the protective agent feeding member coats a protective agent onto the image bearing member and a phenomenon that the protective agent feeding member removes the protective agent from the image bearing member simultaneously occur.

By roughening a surface of the foam layer, the area of the contact between the protective agent feeding member and the protective agent block is reduced. The reduction in the area of the contact causes the pressure applied to the image bearing member to be reduced, and the phenomenon that the protective agent coated onto the image bearing member can be removed to be suppressed. Further, a disadvantageous phenomenon that the protective agent which has been once coated onto the image bearing member is again shaved (recovered) can be suppressed.

The coated protective agent remains unshaved for a long period of time and continues to protect the image bearing member, and, consequently, filming of the image bearing member can be suppressed.

A method for roughening a surface of the foam layer is not particularly limited, and may be properly selected according to purposes. Examples of such a method include (1) a method in which, in forming the foam layer, the foam layer having the convexes is formed with a mold that can form the convexes on a circumscribed surface of the foam layer, (2) a method in which the convexes are formed in the foam layer by shaving the circumscribed surface of the formed foam layer, and (3) a method in which, when the surface is polished to a cylindrical shape by traverse cutting, a rotation speed and a speed in travel in a direction parallel to the axis are varied. Among them, the traverse cutting (3) is particularly preferred from the viewpoint of efficient roughening of the surface of the foam layer.

In the present invention, the maximum height Ry of the foam layer is 400 μm to 1,630 μm, preferably 420 μm to 900 μm from the viewpoint of preventing filming at a small consumption of the protective agent.

When the maximum height Ry is less than 400 μm, the amount of the protective agent on the image bearing member is reduced, leading to filming. On the other hand, when the maximum height Ry is more than 1,630 μm, the protective agent cannot be satisfactorily fed to the image bearing member, leading to filming.

The maximum height Ry may be measured according to JIS B 0601(1994) and JIS B 0031 (1994).

Figure 2:
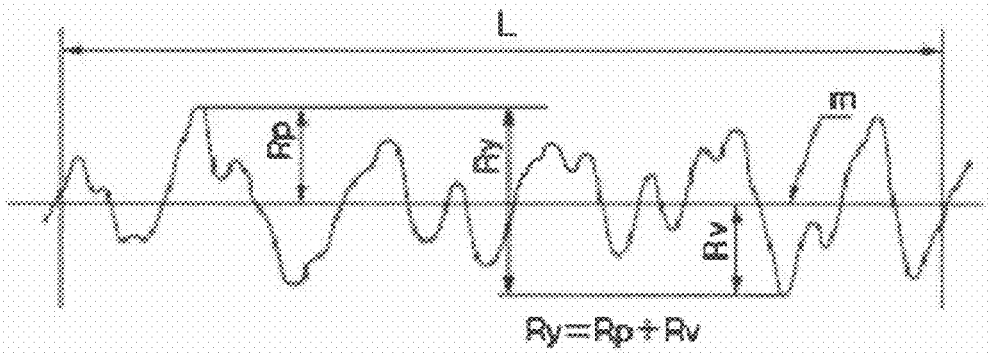
FIG. 2 is a diagram showing a maximum height Ry of a surface of a foam layer in a protective agent feeding member according to the present invention.

In this specification, the maximum height Ry is a property value of the surface roughness obtained by sampling a reference length in an average line direction from a roughness curve, measuring a spacing between a peak line and a valley line in the sampled part in a longitudinal magnification direction of the roughness curve and expressing the value in micrometer (μm) (see FIG. 2).

Figure 3:
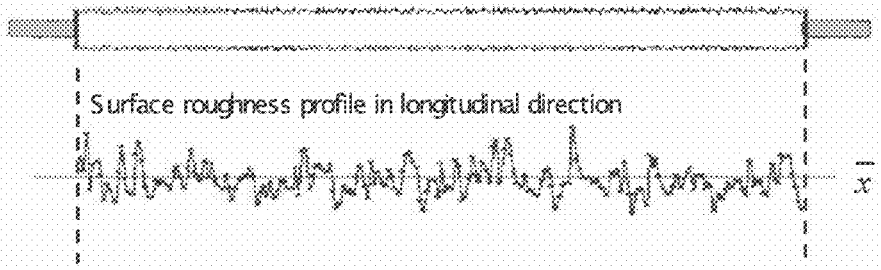
FIG. 3 is a diagram showing how to determine a standard deviation of the surface roughness of a foam layer.

In order to evaluate irregular convexes (surface roughness) formed on the surface of the foam layer in the protective agent feeding member, as shown in FIG. 3, for each point of convexes on the surface of the foam layer, a standard deviation is calculated by the following mathematical expression:

$$s = \sqrt{\frac{1}{n-1}\sum_{i=1}^{n}(x_i - \bar{x})^2}$$

In the expression above, S denotes a standard deviation, n denotes a number of total data, $\bar{x}$ denotes an average data, and $x_i$ denotes each data.

Figure 4:
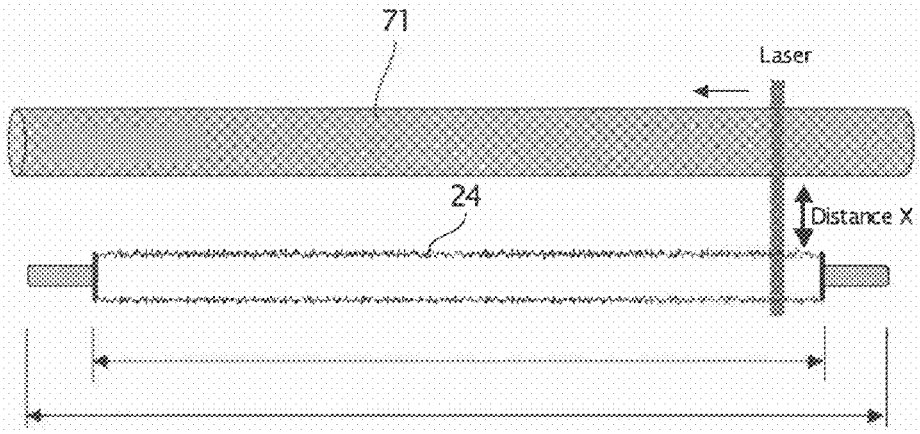
FIG. 4 is a diagram showing an example of a microgauge measuring device for measuring a standard deviation of the surface roughness of a foam layer.

As shown in FIG. 4, the profile of convexes (surface roughness) of the surface of the foam layer is measured in a longitudinal direction by measuring a distance X between a straight edge 71 and a surface of the foam layer 24 with a microgauge measuring device (a noncontact dimension measuring device) with a straight edge (a reference frame) 71 as a reference while travel in an axial direction of the protective agent feeding member.

For example, LMG series manufactured by Tokyo Opto-Electronics Co., Ltd. may be mentioned as a representative measuring device.

The standard deviation of the surface roughness of the foam layer is preferably 0.02 μm to 6 μm, more preferably 0.03 μm to 0.3 μm. When the standard deviation is less than 0.02 μm, the image bearing member is brought into excessive contact with the surface of the foam and filming sometimes occurs by shaving of the coated protective agent. On the other hand, when the standard deviation is more than 6 μm, the probability of contact between the image bearing member and the surface of the foam is reduced and, thus, the amount of the protective agent coated onto the image bearing member is reduced, sometimes leading to filming.

The material for the foam layer is not particularly limited and may be properly selected according to purposes, and examples thereof include polyurethane foam.

—Polyurethane Foam—

The polyurethane foam is not particularly limited and may be properly selected according to purposes. Examples of the polyurethane foam include polyurethane foam obtained by mixing at least a polyol, a polyisocyanate, a catalyst, and a foaming agent together and further if necessary other ingredients such as foam stabilizers and allowing a reaction to proceed.

—Polyol—

The polyol is not particularly limited and may be properly selected according to purposes. Examples thereof include polyether polyol and polyester polyol. Among them, polyether polyol is preferred from the viewpoint of easiness in regulating processability, hardness of the foam layer.

Examples of the polyether polyol include polyether polyol obtained by providing, as an initiator, low-molecular polyol and/or low-molecular polyamine having 2 to 8 active hydrogen groups and subjecting at least either of ethylene oxide or propylene oxide to ring-opening addition polymerization with the initiator.

Examples of the polyether polyol include those generally used in the production of flexible polyurethane foam, such as polyether polyether polyol, polyester polyether polyol, and polymer polyether polyol.

The polyether polyol is preferably polyether polyether polyol, to the terminal of which 5% by mole or more of ethylene oxide has been bonded, from the viewpoint of moldability.

Examples of polyester polyol include those obtained by polymerizing dibasic acid (e.g., adipic acid, phthalic anhydride, isophthalic acid, terephthalic acid, and maleic anhydride) or an anhydride thereof with glycol or triol (e.g., ethylene glycol, diethylene glycol, triethylene glycol, propylene glycol, dipropylene glycol, 1,4-butanediol, glycerin, and trimethylolpropane).

Further, polyester polyol prepared by depolymerizing a waste material of a polyethylene terephthalate resin with the above glycol may also be used.

The polyol may be used independently, or two or more of the aforementioned polyols are used in combination.

—Polyisocyanate—

The polyisocyanate is not particularly limited and may be properly selected according to purposes. Examples thereof include 2,4-tolylenediisocyanate (2,4-TDI), 2,6-tolylenediisocyanate (2,6-TDI), tolidinediisocyanate (TODI), naphthylenediisocyanate (NDI), xylylenediisocyanate (XDI), 4,4'-diphenylmethanediisocyanate (MDI), carbodiimide-modified MDI, polymethylenepolyphenylpolyisocyanate, and polymeric polyisocyanate.

The polyisocyanate may be used independently, or two or more of the aforementioned polyisocyanates may be used in combination.

The amount of the polyisocyanate incorporated is not particularly limited and may be properly selected according to purposes. For example, the equivalent ratio (NCO/OH) of the isocyanate group of the polyisocyante to the hydroxyl group of the polyol is in the range of 1.0 to 3.0.

—Catalyst—

The catalyst is not particularly limited and may be properly selected according to purposes. Examples thereof include an amine catalyst and an organometal catalyst.

Examples of the amine catalyst include triethylenediamine, dimethylethanolamine, and bis(dimethylamino)ethyl ether.

Examples of the organometal catalyst include dioctyltin, distearyltin dibutyrate.

The catalyst may be a reactive catalyst such as dimethylaminoethanol containing active hydrogen.

These may be used independently, or in combination.

The amount of the catalyst incorporated is not particularly limited and may be properly selected according to purposes but is preferably 0.01 parts by mass to 20 parts by mass relative to 100 parts by mass of the polyol.

—Foaming Agent—

The foaming agent is not particularly limited and may be properly selected according to purposes, and examples thereof include water, fluorocarbon compounds, and low-boiling hydrocarbon compounds.

The fluorocarbon compound may be a commercially available product, and examples of such commercially available products include HCFC-141b, HFC-134a, HFC-245fa, and HFC-365mfc manufactured by KANEKO CHEMICAL CO., LTD.

Examples of the low-boiling hydrocarbon compound include cyclopentane, n-pentane, iso-pentane, and n-butane.

These may be used independently, or in combination.

The amount of the foaming agent incorporated is not particularly limited and may be properly selected according to purposes but is preferably 5 parts by mass to 50 parts by mass relative to 100 parts by mass of the polyol.

—Foam Stabilizer—

The foam stabilizer is not particularly limited and may be properly selected according to purposes. Examples of the foam stabilizer include a silicone surfactant.

Commercially available products may be used as the silicone surfactant, and examples of such commercially available products include a dimethylsiloxane foam stabilizer (e.g., "SRX-253" manufactured by Dow Corning Toray Co., Ltd., and "F-122" manufactured by The Shin-Etsu Chemical Co., Ltd.), and a polyether-modified dimethylsiloxane foam stabilizer (e.g., "L-5309" and "SZ-1311" manufactured by Nippon Unicar Co., Ltd.).

The amount of the foam stabilizer incorporated is not particularly limited and may be properly selected according to purposes but is preferably 0.2 parts by mass to 10 parts by mass relative to 100 parts by mass of the polyol.

Other Ingredients

Examples of other ingredients include a crosslinking agent and a foam breaker for regulating the formation of closed cells or interconnecting cells.

The crosslinking agent is not particularly limited and may be properly selected according to purposes. Examples of the crosslinking agent include triethanolamine and diethanolamine.

The foam breaker is not particularly limited and may be properly selected according to purposes. Examples of the foam breaker include a foam stabilizer having high foam breaking properties among the above foam stabilizers.

In producing the polyurethane foam, a method may be used in which starting materials for the polyurethane foam other than the polyisocyanate are previously mixed together and, immediately before the molding, the mixture and the polyisocyanate are mixed together.

The average thickness of the foam layer is not particularly limited and may be properly selected according to purposes but is preferably 1 mm to 5 mm from the viewpoints of small reduction and weight reduction of the whole product.

When the foam layer is cylindrical, the distance between the inner periphery and the circumscribed surface in the cylindrical shape is regarded as the thickness.

The average thickness is an average of measured values obtained by measuring the thickness at any five points of the foam layer.

The structure of the foam layer is not particularly limited and may be properly selected according to purposes, and examples thereof include a structure containing closed cells and a structure containing interconnected cells. The structure containing interconnected cells is preferred because the compressive residual strain is so small that, even when the foam layer of the interconnected cell structure is compressed, the foam layer is easily returned to an original shape and is thus hardly deformed even after long-term use.

The foam layer of the structure containing the closed cells refers to a foam layer having a structure that contains small rooms (sometimes referred to also as "cells") independently of each other and is impermeable to air or water.

The foam layer of the structure containing the interconnected cells refers to a foam layer that contains cells, wherein adjacent cells are connected to each other, and is permeable to air or water.

The number of cells in the foam layer is not particularly limited and may be properly selected according to purposes but is preferably 20 cells/inch (1 inch=2.54 cm) to 300 cells/inch (1 inch=2.54 cm), more preferably 60 cells/inch (1 inch=2.54 cm) to 300 cells/inch (1 inch=2.54 cm).

When the number of cells is less than 20 cells/inch (1 inch=2.54 cm), the suppression of filming in the image bearing member is sometimes difficult, and when the number of cells is more than 300 cells/inch (1 inch=2.54 cm), the suppression of filming in the image bearing member is sometimes difficult. On the other hand, when the number of cells is in the above-defined more preferred range, filming of the image bearing member can advantageously be better suppressed.

The number of cells is an average of measured values obtained by the following method.

Figure 5A:
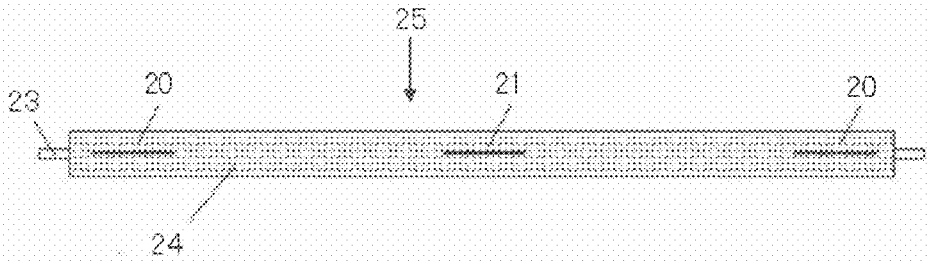
FIG. 5A is a front view of a protective agent feeding member.
Figure 5B:
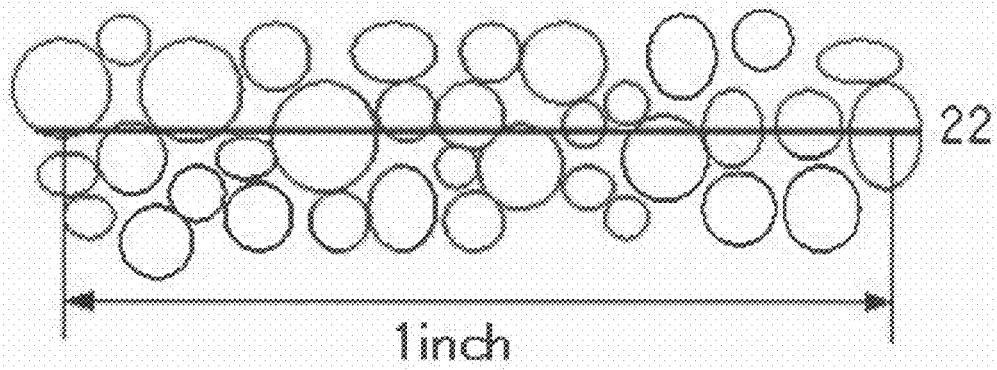
FIG. 5B is an enlarged view of a foam layer in a protective agent feeding member.

In the surface of the foam layer, any three places (numerals 20 and 21 in FIG. 5A) are selected at a position around each of both ends and a center portion in an axial direction of the protective agent feeding member. Here FIG. 5A is a front view of a protective agent feeding member. A protective agent feeding member 25 has a foam layer 24 on an outer periphery of a core 23. In FIG. 5A, numeral 20 represents a measuring portion at the end and numeral 21 represents a measuring portion at the center portion. Next, in each measuring portion, two portions are further selected in a circumferential direction (not shown in FIG. 5A). Thus, nine measuring portions in total are determined. A photograph screen of each measuring portion is then observed under a microscope. As shown in FIG. 5B, a line 22 having a length corresponding to an actual size of one inch (2.54 cm) is then drawn at the center of the photograph screen. The number of cells within the line is counted, and the average of the number of cells in the nine portions is determined. A cell that is in contact with the line 22 of one inch (1 inch=2.54 cm) is counted as one cell even when the degree of contact with the line 22 is slight. For example, in the protective agent feeding member shown in FIG. 5B, the number of cells is 12.

The hardness of the foam layer is not particularly limited and may be properly selected according to purposes but is preferably 40 N to 430 N, more preferably 40 N to 300 N.

When the hardness is less than 40 N, the suppression of filming of the image bearing member is sometimes difficult. Also when the hardness is more than 430 N, the suppression of filming of the image bearing member is sometimes difficult.

On the other hand, when the hardness is in the above-defined more preferred range, filming of the image bearing member is advantageously better suppressed.

The hardness may be measured according to JIS K 6400. The hardness is an average of values obtained by measurement at any a few points on the surface of the foam layer.

In the foam layer, the closed cell structure, the interconnected cell structure, the number of cells, the hardness and the like can be regulated by properly selecting starting materials for the polyurethane foam, and properly adjusting the amount of the foaming agent, reaction conditions and the like in the production of the polyurethane foam.

The protective agent feeding member can be produced by any process without particular limitation, and the production process may be properly selected according to purposes.

A production example wherein the polyurethane foam is used as a material for the foam layer will be explained as one example of a process for producing the protective agent feeding member.

At the outset, starting materials for the polyurethane foam are subjected to foaming/curing by a conventional method to prepare a block-shaped polyurethane foam. The block is then taken off into a necessary shape that is then machined into a cylindrical shape having cells open to the surface, and the core is inserted into the cylindrical shape. The core may be previously coated with an adhesive to enhance the adhesion between the core and the foam layer. Thereafter, the surface of the foam layer of polyurethane foam is then shaved, for example, with a finely machinable polishing, grinding, or cutting machine to a desired average thickness. In this case, traverse grinding is carried out in which a polishing blade is applied to the foam layer while rotating the foam layer and, in this state, the blade is travelled in a direction parallel to the axial direction. The traverse grinding is carried out while varying the rotation speed and the travel speed to form irregular convexes on the surface of the foam layer. The protective agent feeding member is produced through these steps.

Other production examples will be explained.

Starting materials for the polyurethane foam are introduced into a mold, for protective agent feeding member molding, in which the core is housed, followed by foaming/curing to produce the protective agent feeding member.

In the production process using the mold, previously providing a release layer of a fluororesin coating agent or release agent on the surface in the mold is preferred, because complicated machining is unnecessary and the foam layer can have a suitable degree of opening.

(Protective Layer Forming Apparatus)

The protective layer forming apparatus according to the present invention contains at least a protective agent block, a protective agent feeding member and optionally other members such as a pressure applying member and a protective layer forming member.

<Protective Agent Block>

The protective agent block contains a metal salt of fatty acid, an inorganic lubricating agent, and optionally other ingredients.

—Metal Salt of Fatty Acid—

The metal salt of fatty acid is not particularly limited and may be properly selected according to purposes. Examples thereof include a metal salt of stearic acid, a metal salt of oleic acid, a metal salt of palmitic acid, a metal salt of caprylic acid, a metal salt of linolenic acid, and a metal salt of ricinoleic acid. These may be used independently or in combination.

Examples of the metal salt of stearic acid include barium stearate, lead stearate, iron stearate, nickel stearate, cobalt stearate, copper stearate, strontium stearate, calcium stearate, cadmium stearate, magnesium stearate, and zinc stearate.

Examples of the metal salt of oleic acid include zinc oleate, magnesium oleate, iron oleate, cobalt oleate, copper oleate, lead oleate, and manganese oleate.

Examples of the metal salt of palmitic acid include zinc palmitate, cobalt palmitate, lead palmitate, magnesium palmitate, aluminum palmitate, and calcium palmitate.

Examples of the metal salt of caprylic acid include lead caprylate.

Examples of the metal salt of linolenic acid include zinc linolenate, cobalt linolenate, and calcium linolenate.

Examples of the metal salt of ricinoleic acid include zinc ricinoleate and cadmium ricinoleate.

From the viewpoint of well suppressing filming on the image bearing member, among them, the metal salt of stearic acid is preferred, and zinc stearate is more preferred.

—Inorganic Lubricating Agent—

The protective agent block preferably contains an inorganic lubricating agent from the viewpoint of suppressing the contamination of charging unit.

The inorganic lubricating agent is not particularly limited and may be properly selected according to purposes. Examples thereof include mica, boron nitride, molybdenum disulfide, tungsten disulfide, talc, kaolin, montmorillonite, calcium fluoride, and graphite. These may be used independently or in combination. Among them, talc, mica, and boron nitride are particularly preferred from the viewpoint of well suppressing the contamination of the charging unit.

The mixing ratio of the metal salt of fatty acid to the inorganic lubricating agent in the protective agent block is not particularly limited and may be properly selected according to purposes but is preferably 100/0 to 50/50, more preferably 95/5 to 60/40, in terms of mass ratio (metal salt of fatty acid/inorganic lubricating agent). When the mass ratio (metal salt of fatty acid/inorganic lubricating agent) is less than 50/50, the formation of the protective layer on the image bearing member is sometimes difficult. The mass ratio in the above-defined preferred range is advantageous in that filming on the image bearing member and the contamination of the charging unit can be suppressed.

The size and shape of the protective agent block are not particularly limited and may be properly selected according to purposes. Examples of the shape of the protective agent block include a bar shape.

Examples of the bar shape include a square columnar shape and a cylindrical shape.

The protective agent block may be formed by any method without particular limitation and may be properly selected according to purposes. Examples of the formation method thereof include compression molding and melt molding.

—Compression Molding—

The compression molding may be carried out by any method without particular limitation and may be properly selected according to purposes. An example of a method for compression molding will be explained with reference to accompanying drawings.

Figure 6A:
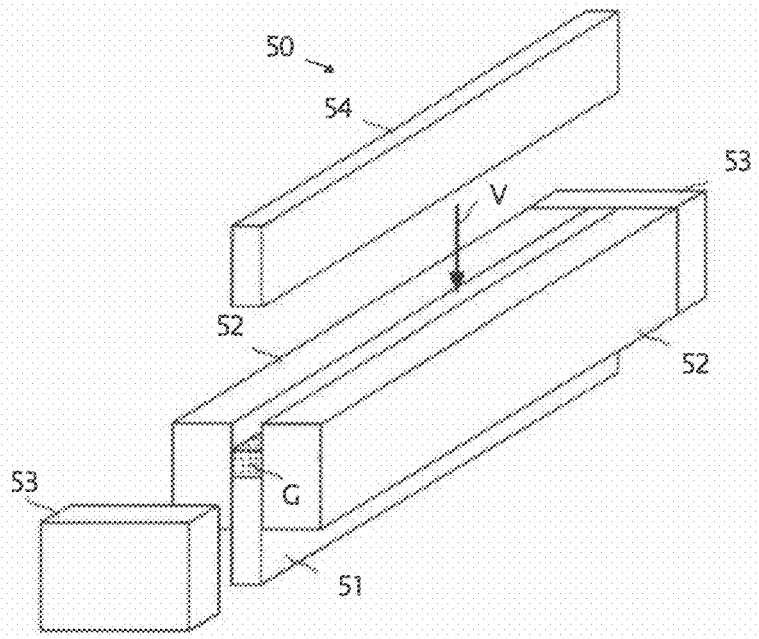
FIG. 6A is a perspective view showing a process for forming a protective agent block by compression molding using an apparatus for manufacturing a protective agent block.
Figure 6B:
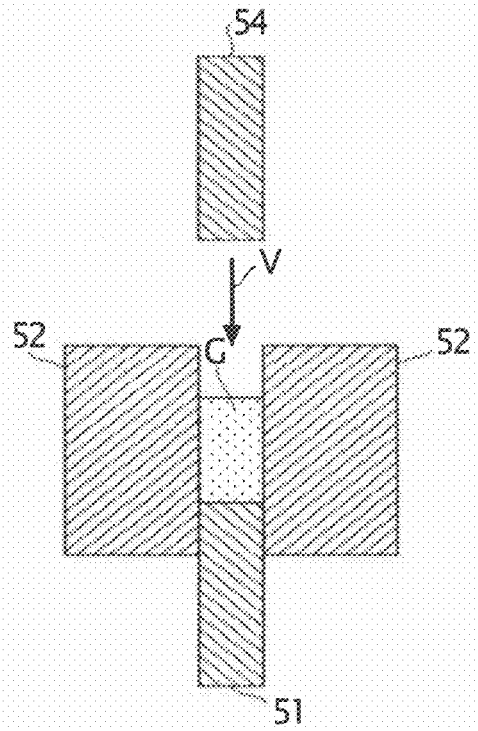
FIG. 6B is a sectional side view of the apparatus for manufacturing a protective agent block shown in FIG. 6A.

FIG. 6A is a perspective view showing a process for forming a protective agent block by compression molding using an apparatus for manufacturing a protective agent block, and FIG. 6B is a sectional side view of the apparatus for manufacturing a protective agent block shown in FIG. 6A.

As shown in FIGS. 6A and 6B, an apparatus 50 for manufacturing the protective agent block contains: a lower mold 51; a pair of transverse molds 52 that are arranged so as to hold the lower mold 51 therebetween and forms longitudinally extended side faces of the protective agent block; a pair of end molds 53 that are arranged to hold the lower mold 51 and the transverse molds 52 therebetween and form longitudinal end faces of the protective agent blocks; and a upper mold 54.

In FIG. 6A, one of the end molds 53 is shown in an exploded state. In fact, the mold 53 is located at a position that faces the other end mold 53, and a closed space excluding a space for the entry of the upper mold 54 is formed by the end molds 53, the lower mold 51, and the transverse molds 52 in the compression molding of the protective agent block which will be described next. Further, when the upper mold 54 is traveled as indicated by an arrow V in FIGS. 6A and 6B and enters the closed space, a completely closed space is formed by the lower mold 51, the transverse molds 52, the end molds 53, and the upper mold 54.

In such a state that the upper mold 54 is removed, a powder G that is a material for the protective agent block is filled into the formed space. The powder G may be formed of particles, granules or a mixture of particles and granules.

After the introduction of the powder G into the space, the upper mold 54 is allowed to enter in a V direction toward the closed space, pressing is performed while forming a completely closed space to form the protective agent block.

Figure 6C:
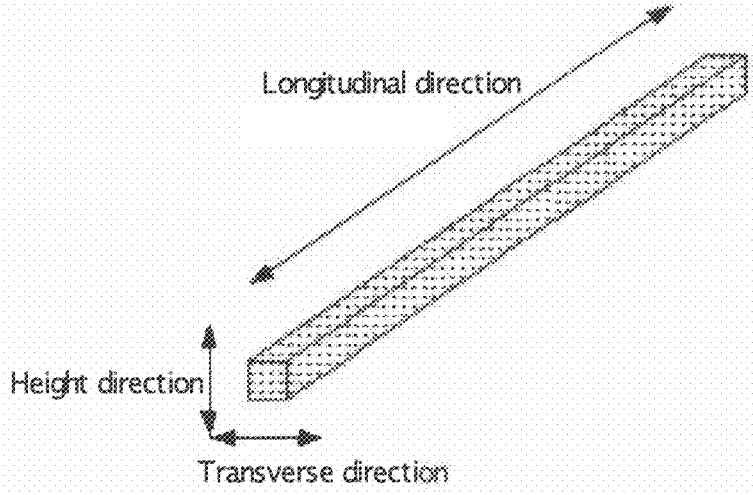
FIG. 6C is a diagram showing an example of the shape of the protective agent block.

Thus, a square columnar protective agent block as shown in FIG. 6C is produced by compression molding through the above steps.

The protective agent block formed by melt molding is semi-transparent, and the protective agent block formed by compression molding is white. Accordingly, these protective agent blocks are visually distinguishable.

<Protective Agent Feeding Member>

The above protective agent feeding member is the protective agent feeding member according to the present invention that shaves off a protective agent from the protective agent block and feeds the protective agent to the surface of the image bearing member.

<Pressure Applying Member>

The pressure applying member is not particularly limited as long as the pressure applying member presses the protective agent block to abut the protective agent block against the protective agent feeding member. The pressure applying member may be properly selected according to purposes, and an example of the pressure applying member is a pressing spring.

<Protective Layer Forming Member>

The protective layer forming member is not particularly limited as long as the protective layer forming member forms a thin layer of the protective agent supplied onto the surface of the image bearing member to form a protective layer. The protective layer forming member may be properly selected according to purposes, and an example of the protective layer forming member is a blade.

The blade may be formed of any material without particular limitation and may be properly selected according to purposes, and examples of a material for the blade include a urethane rubber, a hydrin rubber, a silicone rubber, and a fluoro rubber. These may be used independently or in combination.

The blade in its portion in contact with the image bearing member may be coated with or impregnated with a material having a low coefficient of friction. Further, fillers such as organic fillers or inorganic fillers may be dispersed therein to regulate the hardness of the blade.

The blade is fixed to a blade support by any method such as bonding or fusion so that the front portion can be pressed and abutted against the surface of the image bearing member. Although the thickness of the blade cannot be unequivocally specified because a relationship with a pressing force should be taken into consideration, the thickness is preferably 0.5 mm to 5 mm, more preferably 1 mm to 3 mm.

Likewise, although the length of the blade that is protruded from the blade support and can be bent, the so-called free length, cannot be unequivocally specified because a relationship with a pressing force should be taken into consideration, the length is preferably 1 mm to 15 mm, more preferably 2 mm to 10 mm.

An example of other construction of the protective layer forming member is a construction obtained by forming a covering layer of a resin, a rubber, or an elastomer by a coating, dipping or other method on the surface of an elastic metal blade such as a spring sheet, if necessary, for example, through a coupling agent or a primer component, if necessary, heat curing the coating and, if necessary, subjecting the coating to surface polishing or the like.

The covering layer contains a binder resin and a filler and, further if necessary, other ingredients.

The binder resin is not particularly limited and may be properly selected according to purposes. Examples of the binder resin include a fluororesin such as perfluoroalkoxyalkane (PFA), polytetrafluoroethylene (PTFE), tetrafluoroethylene-hexafluoropropylene copolymer (FEP), and polyvinylidene chloride (PVdF); and a silicone elastomer such as a fluoro rubber and a methylphenylsilicone elastomer.

The thickness of the elastic metal blade is not particularly limited and may be properly selected according to purposes but is preferably 0.05 mm to 3 mm, more preferably 0.1 mm to 1 mm. The elastic metal blade may be subjected to bending in a direction substantially parallel to a spindle after mounting to suppress twisting of the blade.

A force by which the protective agent block is spread to form a protective layer suffices for pressing of the protective layer forming member against the image bearing member, and the linear pressure is preferably 5 gf/cm to 80 gf/cm, more preferably 10 gf/cm to 60 gf/cm.

The protective layer forming member may serves also as a cleaning unit. In order to more reliably form a protective layer, however, preferably, a residue composed mainly of the toner on the image bearing member is previously removed by a cleaning unit to avoid the entry of the residue into the protective layer.

Figure 7:
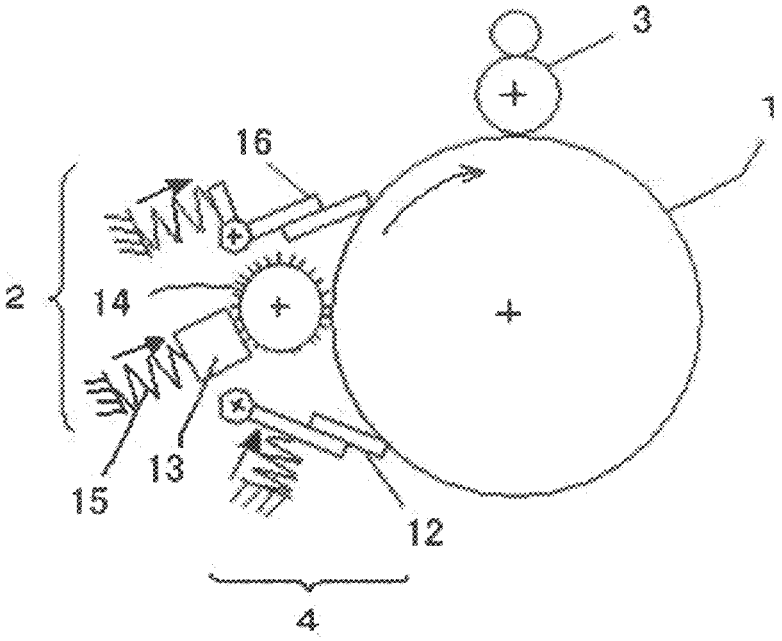
FIG. 7 is a schematic cross-sectional view of an example of a protective layer forming apparatus according to the present invention.

The protective layer forming apparatus according to the present invention will be described with reference to the accompanying drawings. FIG. 7 is a schematic cross-sectional view of the protective layer forming apparatus according to the present invention.

A protective layer forming apparatus 2 provided to face a photoconductor drum 1 which is an image bearing member is composed mainly of a protective agent block 13, a protective agent feeding member 14, a pressure applying member 15, and a protective layer forming member 16.

The protective agent block 13 is brought into contact with the roller-shaped protective agent feeding member 14 by pressing of the pressure applying member 15. The protective agent feeding member 14 is rotated while providing a linear velocity difference from the photoconductor drum 1 to rub the photoconductor drum 1 therewith, and, at that time, the protective agent held on the surface of the protective agent feeding member is fed onto the surface of the image bearing member.

The protective agent supplied onto the surface of the image bearing member does not form a satisfactory protective layer when some substances are selected. Accordingly, in order to form a more even protective layer, for example, a thin layer is formed as a protective layer by a protective layer forming member 16 having a blade-shaped member.

For example, a charging unit 3 with a direct current voltage or a voltage obtained by superimposing an alternating current voltage on a direct current voltage applied by a high-voltage power supply (not shown) is brought into contact with or is allowed to come close to the image bearing member with the protective layer formed thereon to electrify the image bearing member through discharge in minute gaps. At that time, a part of the protective layer is decomposed or oxidized by an electric stress, and, further, an aerial discharge product is deposited on the surface of the protective layer.

The deteriorated protective agent, together with a component which stays on the image bearing member such as the toner, is removed by a conventional cleaning unit. The cleaning unit serves also as the protective layer forming member 16. A function of removing a residue that stays on the surface of the image bearing member and a function of forming a protective layer are sometimes different from each other in a rubbing state of a proper member. Accordingly, preferably, the functions are separated, and, as shown in FIG. 7, a cleaning unit 12 or a cleaning unit containing a cleaning pressing mechanism or the like is provided on an upstream side of the protective agent feeding member.

(Image Forming Apparatus and Method for Image Formation)

The image forming apparatus according to the present invention contains at least an image bearing member, a charging unit, an exposure unit, a developing unit, a transferring unit, a fixing unit, a cleaning unit, and a protective layer forming unit and, further if necessary, properly selected other units, for example, a discharging unit, a recycling unit, and a controlling unit.

The method for image formation used in the present invention contains at least a charging step, an exposure step, a developing step, a transferring step, a fixing step, a cleaning step, and a protective layer forming step and, further if necessary, properly selected other steps, for example, a diselectrification step, a recycling step, and a controlling step.

The method for image formation used in the present invention can be more suitably carried out by the image forming apparatus according to the present invention, the charging step can be carried out by the charging unit, the exposure step can be carried out by the exposure unit, the developing step can be carried out by the developing unit, the transferring step can be carried out by the transferring unit, the fixing step can be carried out by the fixing unit, the cleaning step can be carried out by the cleaning unit, the protective layer forming step can be carried out by the protective layer forming unit, and the other steps can be carried out by the other units.

<Image Bearing Member>

For the image bearing member (hereinafter referred to as "photoconductor"), the material, shape, structure, size and the like are not particularly limited and may be properly selected from conventional ones. A drum shape is suitable as the shape of the image bearing member. Examples of a material for the image bearing member include an inorganic photoconductor such as amorphous silicon and selenium and an organic photoconductor such as polysilane and phthalopolymethine.

The image bearing member used in the image forming apparatus according to the present invention contains an electroconductive support, at least a photosensitive layer provided on the electroconductive support and, further if necessary, other layers.

The photosensitive layer is a single layer photosensitive layer containing a charge generating material and a charge transport material that are present as a mixture, a laminate photosensitive layer containing a charge transport layer provided on a charge generating layer, or a reverse laminate photosensitive layer containing a charge generating layer provided on a charge transport layer. An uppermost layer may also be provided on the photosensitive layer to improve mechanical strength, abrasion resistance, gas proofness, cleaning properties and the like of the photoconductor. An undercoating layer may be provided between the photosensitive layer and the electroconductive support. Further, if necessary, plasticizers, antioxidants, leveling agents and the like may also be added in a suitable amount to the layers.

The electroconductive support is not particularly limited as long as it has an electrical conductivity of $1.0\times10^{10}$ Ω·cm or less in terms of volume resistivity. The electroconductive support may be properly selected according to purposes. Examples thereof include products obtained by covering a metal such as aluminum, nickel, chromium, nichrome, copper, gold, silver, or platinum, or a metal oxide such as tin oxide or indium oxide by vapor deposition or sputtering on film-like or cylindrical plastic or paper, or aluminum, aluminum alloy, nickel, stainless steel or other plates and pipes obtained by subjecting the plates to extrusion, drawing or the like to prepare element tubes and then subjecting the element tubes to cutting, super finishing, polishing or the like.

The diameter of the drum-shaped support is preferably 20 mm to 150 mm, more preferably 24 mm to 100 mm, still more preferably 28 mm to 70 mm. When the diameter of the drum-shaped support is less than 20 mm, the arrangement of charging, exposure, development, transfer, and cleaning steps around the drum sometimes becomes physically difficult. On the other hand, when the diameter of the drum-shaped support is greater than 150 mm, disadvantageously, the size of the image forming apparatus is sometimes increased. In particular, when the image forming apparatus is of a tandem type, a plurality of photoconductors should be loaded. Accordingly, the diameter is preferably 70 mm or less, more preferably 60 mm or less. Further, endless nickel belts or endless stainless steel belts as disclosed in Japanese Patent Application Laid-Open (JP-A) No. 52-36016 are also usable as the electroconductive support.

The undercoating layer of the photoconductor may have a single-layer structure or a multilayer structure of two or more layers. Examples of undercoating layers include (1) a layer composed mainly of a resin, (2) a layer composed mainly of a white pigment and a resin, and (3) a metal oxide film formed by chemically or electrochemically oxidizing a surface of an electroconductive base. Among them, a layer composed mainly of a white pigment and a resin is preferred.

Examples of the white pigment include metal oxides such as titanium oxide, aluminum oxide, zirconium oxide, and zinc oxide. Among them, titanium oxide is particularly preferred as it can well prevent injection of charges from the electroconductive support.

Examples of the resin include a thermoplastic resin such as a polyamide resin, a polyvinyl alcohol resin, cesein, and methylcellulose; and a thermoset resin such as an acrylic resin, a phenolic resin, a melamine resin, an alkyd resin, an unsaturated polyester resin, and an epoxy resin. These may be used independently or in combination.

The thickness of the undercoating layer is not particularly limited and may be properly selected according to purposes but is preferably 0.1 μm to 10 μm, more preferably 1 μm to 5 μm.

Examples of a charge generating substance for use in the photosensitive layer include: an azo pigment such as a monoazo pigment, a bisazo pigment, a trisazo pigment, and a tetrakisazo pigment; an organic pigment or dye such as a triarylmethane dye, a thiazine dye, an oxazine dye, a xanthene dye, a cyanine dye, a styryl dye, a pyrilium dye, a quinacridone pigment, an indigo pigment, a perylene pigment, a polycyclic quinone pigment, a bisbenzimidazole pigment, an indanthrone pigment, a squarylium pigment, and a phthalocyanine pigment; and an inorganic material such as selenium, selenium-arsenic, selenium-tellurium, cadmium sulfide, zinc oxide, titanium oxide, and amorphous silicon. These may be used independently or in combination.

Examples of a charge transport substance for use in the photosensitive layer include anthracene derivatives, pyrene derivatives, carbazole derivatives, tetrazole derivatives, metallocene derivatives, phenothiazine derivatives, a pyrazoline compound, a hydrazone compound, a styryl compound, a styrylhydrazone compound, an enamine compound, a butadiene compound, a distyryl compound, an oxazole compound, an oxadiazole compound, a thiazole compound, an imidazole compound, triphenyl amine derivatives, phenylene-diamine derivatives, aminostilbene derivatives, and triphenylmethane derivatives. These may be used independently or in combination.

Examples of a binder resin used for forming the photosensitive layer include a thermoplastic resin, a thermoset resin, a photocurable resin, and a photoconductive resin, all of which are electrically insulative and are known in the art. Examples of such the resins include: a thermoplastic resin such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (meth) acrylic resin, polystyrene, polycarbonate, polyallylate, polysulfone, polyether sulfone, and ABS resins; and a thermoset resin such as a phenolic resin, an epoxy resin, a urethane resin, a melamine resin, an isocyanate resin, an alkyd resin, a silicone resin, and a heat curable acrylic resin; and others such as polyvinyl carbazole, polyvinyl anthracene, and polyvinyl pyrene. These may be used independently or in combination.

The uppermost surface layer of the photoconductor is provided to improve mechanical strength, abrasion resistance, gas proofness, and cleaning properties of the photoconductor. An uppermost surface layer formed of a polymer having a higher mechanical strength than the photosensitive layer or a dispersion of an inorganic filler in a polymer is suitable. The resin used in the uppermost surface layer may be any of a thermoplastic resin and a heat curable resin. The heat curable resin is particularly preferred because of high mechanical strength and a very high capability of suppressing abrasion by friction against the cleaning blade. Even though the uppermost surface layer has no charge transport capacity, no problem occurs when the thickness of the uppermost surface layer is small. When the surface layer having no charge transport capacity is formed thick, a lowering in sensitivity of the photoconductor, a rise in potential after exposure, and a rise in residual potential are likely to occur. Accordingly, the incorporation of the above charge transport substance in the uppermost surface layer or the use of a polymer having a charge transport capacity as the polymer used in the uppermost surface layer is preferred.

The photosensitive layer and the uppermost surface layer are generally significantly different from each other in mechanical strength. Accordingly, when the uppermost surface layer is abraded by friction against the cleaning blade and disappears, the photosensitive layer is soon abraded. Therefore, when the uppermost surface layer is provided, it is important that the uppermost surface layer has a satisfactory thickness. The thickness of the uppermost surface layer is preferably 0.1 μm to 12 μm, more preferably 1 μm to 10 μm, particularly preferably 2 μm to 8 μm. When the thickness is less than 0.1 μm, due to excessively small thickness, the uppermost surface layer is likely to partially disappear by friction against the cleaning blade and the abrasion of the photosensitive layer sometimes proceeds from the disappeared portion. On the other hand, when the thickness of the uppermost surface layer is greater than 12 μm, a lowering in sensitivity, a rise in potential after exposure, and a rise in residual potential are likely to occur. In particular, when a polymer having a charge transport capacity is used, the cost of the polymer having a charge transport capacity is sometimes disadvantageously increased.

The resin used in the uppermost surface layer is preferably transparent to writing light in image formation and has excellent insulation, mechanical strength, and adhesion, and examples thereof include ABS resins, ACS resins, olefin-vinyl monomer copolymers, chlorinated polyethers, allyl resins, phenolic resins, polyacetals, polyamides, polyamide-imides, polyacrylates, polyallylsulfones, polybutylenes, polybutylene terephthalates, polycarbonates, polyether sulfones, polyethylenes, polyethylene terephthalates, polyimides, acrylic resins, polymethylpentene, polypropylenes, polyphenylene oxides, polysulfones, polystyrenes, AS resins, butadiene-styrene copolymers, polyurethanes, polyvinyl chlorides, polyvinylidene chlorides, and epoxy resins. These polymers may be thermoplastic resins. In order to enhance mechanical strength of the polymer, however, the polymers may be crosslinked with a crosslinking agent containing polyfunctional acryloyl, carboxyl, hydroxyl, amino or other group to produce heat curable resins. The use of the heat curable resins can increase the mechanical strength of the uppermost surface layer and can significantly reduce abrasion by friction against the cleaning blade.

The uppermost surface layer preferably has a charge transport capacity. Examples of possible methods for imparting a charge transport capacity to the uppermost surface layer include a method in which the polymer used in the uppermost surface layer is mixed with the charge transport substance and a method in which a polymer having a charge transport capacity is used in the uppermost surface layer. The latter method is preferred because a photoconductor that has high sensitivity and is less likely to cause a rise in potential after exposure and a rise in residual potential can be obtained.

Preferably, the uppermost surface layer contains metallic fine particles, metal oxide fine particles, or other fine particles from the viewpoint of enhancing the mechanical strength of the uppermost surface layer. Examples of metal oxides include titanium oxide, tin oxide, potassium titanate, titanium nitride, zinc oxide, indium oxide, and antimony oxide. Examples of other fine particles include fluoro resins such as polytetrafluoroethylene, silicone resins, and a dispersion of an inorganic material in these resins that are used from the viewpoint of improving abrasion resistance.

<Charging Step and Charging Unit>

The charging step is a step that electrifies the surface of the image bearing member.

The charging step can be carried out by applying a voltage to the surface of the image bearing member using the charging unit. The charging unit is disposed in contact with or near the surface o the image bearing member.

The charging unit is not particularly limited and may be properly selected according to purposes. Examples of the charging unit include conventional contact chargers known in the art, each of which is equipped with an electroconductive or semi-electroconductive roll, brush, film, or a rubber blade, and non-contact chargers each utilizing a corona discharge such as corotron or scorotron.

Preferably, the charging unit is one that applies a voltage having an alternating current component.

<Exposure Step and Exposure Unit>

The exposure step is a step of, after the charging of the surface of the image bearing member, exposing image-wise the surface of the image bearing member to form a latent electrostatic image and may be carried out by the exposure unit.

The exposure unit is not particularly limited as long as, for example, the surface of the image bearing member electrified by the charging unit can be exposed image-wise in a contemplated form. The exposure unit may be selected according to purposes, and examples thereof include various photographic filters such as copying optical systems, rod lens array systems, laser optical systems, and liquid crystal shutter optical systems.

In the present invention, a back exposure method may be adopted in which image-wise exposure is carried out from the backside of the image bearing member.

<Developing Step and Developing Unit>

The developing step is a step of developing the latent electrostatic image with a toner or a developer to form a visible image.

The visible image may be formed, for example, by developing the latent electrostatic image with the toner or the developer, and the development may be carried out by the developing unit.

The developing unit is not particularly limited as long as, for example, the development can be carried out with the toner or the developer. The developing unit may be properly selected from conventional ones. A suitable example of the developing unit contains at least, for example, a processing machine that contains the toner or the developer and can apply the toner or the development agent to the latent electrostatic image in a contact or non-contact manner.

—Toner—

The toner is not particularly limited and may be properly selected according to purposes. An example of the toner is one prepared by subjecting a toner composition containing a polyester prepolymer having a nitrogen atom-containing functional group, a compound that can cause an elongation or crosslinking reaction with the prepolymer, a polyester, a colorant, and a release agent in an aqueous medium in the presence of resin fine particles to elongation and/or crosslinking reaction. Hot offset can be reduced by curing the surface of this toner.

An isocyanate group-containing polyester prepolymer may be mentioned as the polyester prepolymer having a nitrogen atom-containing functional group, and amines may be mentioned as the compound that cause an elongation or crosslinking reaction with the prepolymer.

A product obtained by further reacting a polyester, which is a condensate of a polyol with a polycarboxylic acid and has an active hydrogen group, with a polyisocyanate may be mentioned as the polyester prepolymer having an isocyanate group. Examples of active hydrogen groups possessed by the polyester include a hydroxyl group (an alcoholic hydroxyl group and a phenolic hydroxyl group), an amino group, a carboxyl group, and a mercapto group. Among them, the alcoholic hydroxyl group is particularly preferred.

The polyol is not particularly limited and may be properly selected according to purposes, and examples thereof include diols and trivalent or higher polyols. Among them, a diol alone or a mixture of a diol with a small amount of a trivalent or higher polyol is preferred.

The polycarboxylic acid is not particularly limited and may be properly selected according to purposes, and examples thereof include dicarboxylic acids and trivalent or higher polycarboxylic acids. Among them, a dicarboxylic acid alone or a mixture of a dicarboxylic acid with a small amount of a trivalent or higher polycarboxylic acid is preferred.

The ratio of the polyol to the polycarboxylic acid is preferably 2/1 to 1/1, more preferably 1.5/1 to 1/1, still more preferably 1.3/1 to 1.02/1, in terms of the equivalent ratio of the hydroxyl group [OH] to the carboxyl group [COOH], i.e., [OH]/[COOH].

Examples of the polyisocyanate include: aliphatic polyisocyanate (e.g., tetramethylene diisocyanate, hexamethylene diisocyanate, and 2,6-diisocyanate methyl caproate); alicyclic polyisocyanate (e.g., isophorone diisocyanate, and cyclohexylmethane diisocyanate); aromatic diisocyanate (e.g., tolylenediisocyanate, diphenylmethane diisocyanate); aromatic aliphatic diisocyanate (e.g., α,α,α', α'-tetramethylxylylene diisocyanate); isocyanurate; and products obtained by blocking the polyisocyanates with phenol derivatives, oximes, caprolactams or the like. These may be used independently or in combination.

Regarding the ratio of the polyisocyanate, the equivalent ratio between the isocyanate group [NCO] and the hydroxyl group [OH] of polyester having a hydroxyl group, i.e., [NCO]/[OH], is preferably 5/1 to 1/1, more preferably 4/1 to 1.2/1, still more preferably 2.5/1 to 1.5/1. When the ratio [NCO]/[OH] is greater than 5, low-temperature fixation is deteriorated. On the other hand, when the molar ratio of [NCO] is less than 1, the content of urea in modified polyester is so low that hot offset resistance is deteriorated.

Examples of the amine include diamine, trivalent or higher polyamine, amino alcohol, aminomercaptan, amino acid, and products obtained by blocking amino group in any of these amines. Among them, diamine or mixtures of diamine with trivalent or higher polyamine are preferred.

Further, if necessary, the molecular weight of urea modified polyester can be regulated with an elongation terminator. Elongation terminators include monoamines (e.g., diethylamine, dibutylamine, butylamine, and laurylamine) or products obtained by blocking the monoamines (e.g., ketimine compounds).

Preferably, the toner has the following mass average particle diameter (D4)/number average particle diameter (D1), average circularity and the like.

—Ratio of Mass Average Particle Diameter to Number Average Particle Diameter—

In the toner, the ratio of mass average particle diameter (D4) to number average particle diameter (D1), i.e., (D4/D1), is preferably 1.0 to 1.4.

When the ratio of mass average particle diameter (to number average particle diameter, i.e., (D4/D1), is less than 1.0, in the case of a two-component developer, the toner fuses to the surface of the carrier in long-term agitation in the developing unit. This phenomenon is likely to cause a lowering in the charging capacity of the carrier or deterioration in cleaning properties. In a one-component developer, filming of toner on the development roller or fusion of the toner to a member such as the blade derived from the formation of a thin toner layer is likely to occur. When the ratio (D4/D1) is greater than 1.4, it is difficult to obtain an image having high resolution and high quality and, in toner balancing in the developer, a variation in particle diameter of the toner is sometimes increased. On the other hand, lowering the ratio of the mass average particle diameter to the number average particle diameter (D4/D1) can allow a charging amount distribution to become uniform and can reduce background fogging.

In the toner, when the ratio of the mass average particle diameter to the number average particle diameter (D4/D1) is in the above-defined preferred range, the toner is likely to possess all of storage stability, low-temperature fixation, and hot offset resistance. In particular, when the toner is used in a full-color copying machine, an image having good gloss can be obtained. In the two-component developer, even when long-term toner balancing is carried out, a variation in diameter of toner particles in the developer is small and, also in long-term agitation in the developing unit, good and stable development can be realized. In the one-component developer, even in toner balancing, a variation in diameter of toner particles is reduced and, at the same time, neither filming of the toner on the development roller nor fusion of the toner to a member such as a blade derived from the formation of a thin toner layer occurs. Even in long-term use (agitation) of the developing unit, good and stable development can be realized, and a high-quality image can be obtained.

The mass average particle diameter (D4) and the number average particle diameter (D1) of the toner can be determined, for example, by measuring the diameter of particles with a particle size measuring device (Multisizer III, manufactured by Beckman Coulter, Inc.) at an aperture diameter of 100 μm and analyzing the obtained data with an analysis software (Beckman Coulter Multisizer 3 Version 3.51).

—Average Circularity—

The average circularity of the toner is preferably 0.93 to 1.00. When the average circularity is less than 0.93, image uniformity in the development is deteriorated or the efficiency of toner transfer from a photoconductor to an intermediate transfer medium or from the intermediate transfer medium to a recording medium is lowered making it impossible to provide uniform transfer.

The average circularity of the toner is defined by circularity SR=(boundary length of circle having the same area as particle projection area/boundary length of particle projection image)×100%

Further, in the method for image formation and the image forming apparatus, not only a polymerization method toner having a construction suitable for the provision of high-quality images but also a toner having irregular shapes obtained by a grinding method can be applied. Also in this case, the service life of the apparatus can be significantly prolonged. Materials commonly usable as electrophotographic toners can be applied as materials constituting the toner obtained by the grinding method without particular limitation.

The processing machine may be of a dry development type or a wet development type, or a single-color processing machine or a multi-color processing machine. For example, a processing machine containing an agitator, which performs friction agitation of the toner or the developer for charging, and a rotatable magnet roller is suitable.

For example, the toner and the carrier are mixed and agitated within the processing machine. At that time, the toner is electrified by friction and is held in a napping state on the surface of the magnet roller being rotated to form a magnetic brush. Since the magnet roller is disposed near the image bearing member, a part of the toner constituting the magnetic brush formed on the surface of the magnet roller is traveled to the surface of the image bearing member by electrical attraction. As a result, the latent electrostatic image is developed with the toner to form a visible image of the toner on the surface of the image bearing member.

The developer stored in the processing machine is a developer containing the toner. The developer may be a one-component developer or a two-component developer.

<Transferring Step and Transferring Unit>

The transferring step is a step of transferring the visible image onto a recording medium. In a preferred embodiment, a visible image is transferred by primary transfer on an intermediate transfer medium, and the visible image is transferred by secondary transfer onto the recording medium. In a more preferred embodiment, toners of two or more colors, preferably full color toners, are used and two steps, that is, a primary transferring step of transferring a visible image on an intermediate transfer medium to form a composite transfer image and a secondary transferring step of transferring the composite transfer image onto a recording medium, are included.

The transfer can be carried out, for example, by electrifying the image bearing member with a transfer electrifier to transfer the visible image. The transfer can be carried out by the transferring unit. In a preferred embodiment, the transferring unit contains a primary transferring unit that transfers a visible image onto an intermediate transfer medium to form a composite transfer image and a secondary transferring unit that transfers the composite transfer image onto the recording medium.

The intermediate transfer medium is not particularly limited and may be properly selected from conventional transfer mediums according to purposes. For example, a transfer belt is suitable as the intermediate transfer medium.

The image bearing member may be an intermediate transfer medium used in image formation by the so-called intermediate transfer method in which a toner image formed on the image bearing member is transferred by primary transfer to perform color superimposition, followed by transfer onto a recording medium.

—Intermediate Transfer Medium—

Preferably, the intermediate transfer medium has an electrical conductivity of $1.0\times10^{5}$ Ω·cm to $1.0\times10^{11}$ Ω·cm in terms of volume resistivity. When the volume resistivity is less than $1.0\times10^{5}$ Ω·cm, in the transfer of a toner image from the photoconductor to the intermediate transfer medium, the so-called transfer scattering occurs that involves discharge and causes toner image disturbance. On the other hand, when the volume resistivity is more than $1.0\times10^{11}$ Ω·cm, after the transfer of the toner image from the intermediate transfer medium onto a recording medium such as paper, counter charges of the toner image stay on the intermediate transfer medium and sometimes appear as an afterimage on a next image.

The intermediate transfer medium may be a belt-shaped or cylindrical plastic obtained, for example, by kneading metal oxides such as tin oxide or indium oxide, electroconductive particles such as carbon black, or electroductive polymers (either alone or in combination) with a thermoplastic resin and extruding the kneaded product. In addition, an endless belt-shaped intermediate transfer medium can also be obtained by optionally adding the above electroconductive particles or electroconductive polymers to a resin liquid containing a heat crosslinkable monomer or oligomer and centrifugally molding the resin liquid with heating.

In providing a surface layer on the intermediate transfer medium, a composition containing materials for the surface layer used in the surface layer of the photoconductor except for the charge transport material is appropriately used in combination with the electroconductive substance to perform resistance adjustment before use of the composition.

The transferring unit (the primary transferring unit and the secondary transferring unit) preferably contains at least a transfer device that separates and electrifies the visible image formed on the image bearing member for transfer to the recording medium side. The number of transferring units used may be either one or two or more. Examples of transfer devices include corona transfer devices by corona discharge, transfer belts, transfer rollers, pressure transfer rollers, and pressure-sensitive transfer devices.

The recording medium is not particularly limited and may be properly selected from conventional recording media (recording papers).

<Fixing Step and Fixing Unit>

The fixing step is a step of fixing the visible image transferred onto the recording medium by the fixing unit. The fixing step may be carried out every time when each color toner is transferred onto the recording medium, or alternatively, may be carried out at a time in such a state that the color toners are stacked on top of each other.

The fixing unit is not particularly limited and may be selected according to purposes. However, conventional heating/pressing units are suitable. Heating/pressing units include a combination of a heating roller with a pressure roller and a combination of a heating roller with a pressure roller and an endless belt.

In general, heating in the heating/pressing unit is preferably 80° C. to 200° C.

In the present invention, according to purposes, for example, a conventional photofixing device may be used together with or instead of the fixing step and the fixing unit.

<Protective Layer Forming Step and Protective Layer Forming Unit>

The protective layer forming step is a step of applying a protective agent onto the surface of the image bearing member after transfer to form a protective layer.

The protective layer forming apparatus according to the present invention described above may be used as the protective layer forming unit.

<Cleaning Step and Cleaning Unit>

The cleaning step is a step of removing the toner that stays on the image bearing member and can be suitably carried out by a cleaning unit.

The cleaning unit is preferably provided at a position that is on the downstream side of the transferring unit and is on the upstream side of the protective layer forming unit.

The cleaning unit is not particularly limited as long as it can remove the electrophotographic toner that stays on the image bearing member. The cleaning unit can be properly selected from conventional cleaners. Examples of suitable cleaners include magnetic brush cleaners, electrostatic brush cleaners, magnetic roller cleaners, blade cleaners, brush cleaners, and web cleaners.

<Discharging Step and Discharging Unit>

The discharging step is a step of applying a discharging bias to the image bearing member to perform discharging and can be suitably carried out by a discharging unit.

The discharging unit is not particularly limited as far as it can apply a discharging bias to the image bearing member and may be properly selected from conventional discharging devices. Examples of suitable discharging devices include discharging lamps.

<Recycling Step and Recycling Unit>

The recycling step is a step of recycling the toner removed by the cleaning step to the developing unit and can be suitably carried out by a recycling unit.

The recycling unit is not particularly limited and may be a conventional conveying unit.

<Controlling Step and Controlling Unit>

The controlling step is a step of controlling each of the steps and can be suitably carried out by a controlling unit.

The controlling unit is not particularly limited as long as the movement of each of the units can be controlled. The controlling unit may be properly selected according to purposes, and examples thereof include equipment such as sequencers and computers.

Figure 9:
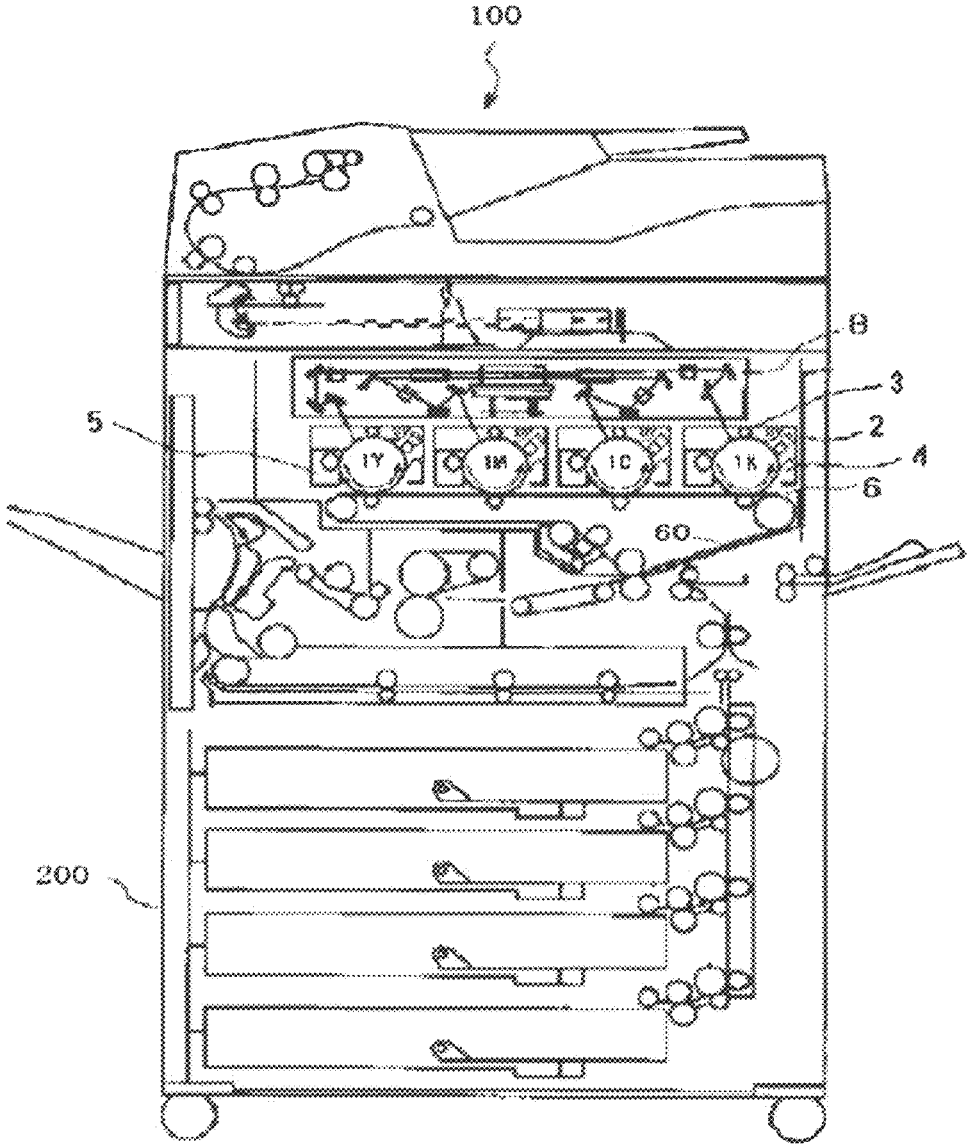
FIG. 9 is a schematic cross-sectional view of an example of an image forming apparatus according to the present invention.

Here FIG. 9 is a schematic cross-sectional view of one example of an image forming apparatus 100 according to the present invention. A protective layer forming apparatus 2, a charging unit 3, an exposure unit 8, a developing unit 5, a transferring unit 6, and a cleaning unit 4 are arranged around drum-shaped image bearing members 1Y, 1M, 1C, 1K, and an image is formed by the following operation.

Next, a series of processes for image formation will be explained by taking a negative-positive process.

An image bearing member typified by an organic photoconductor (OPC) having an organic photoconductive layer is neutralized with a discharging lamp (not shown) or the like and is uniformly negatively electrified with a charging unit 3.

In the charging of the image bearing member by the charging unit, a voltage having a suitable intensity or an electrified voltage obtained by superimposing an alternating current voltage on the voltage, which is suitable for the charging of image bearing members 1Y, 1M, 1C, 1K to a desired potential is applied to the charging unit 3 from a voltage applying mechanism (not shown).

In the electrified image bearing members 1Y, 1M, 1C, 1K, a latent image is formed by laser beams applied by an exposure unit 8 such as a laser optical system (the absolute value of the potential in exposed areas being lower than the absolute value of the potential in non-exposed areas).

Laser beams are emitted from a semiconductor laser and scan the surface of the image bearing members 1Y, 1M, 1C, 1K in a direction of rotational axis of the image bearing members, for example, by a polygonal columnar polygonal mirror (polygon) being rotated at a high speed.

The latent image thus formed is developed with a toner supplied on a development sleeve which is a developer support in the developing unit 5, or a development agent composed of a mixture of toner and carrier particles to form a toner visible image.

In the development of the latent image, a voltage having a suitable intensity or a development bias obtained by superimposing an alternating current voltage on the voltage, which is present between exposed areas and non-exposed areas in the image bearing members 1Y, 1M, 1C, 1K is applied to the development sleeve from the voltage applying mechanism (not shown).

Toner images formed on the image bearing members 1Y, 1M, 1C, 1K corresponding to respective colors are transferred onto an intermediate transfer medium 60 by a transferring unit 6, and the toner images are transferred onto a recording medium such as paper fed from a paper feed mechanism 200.

At that time, preferably, a potential having a polarity opposed to a polarity of the toner charging is applied as a transfer bias to the transferring unit 6. Thereafter, the intermediate transfer medium 60 is separated from the image bearing members to obtain a transferred image.

The toner that stays on the image bearing members is collected by a cleaning unit and is recovered into a toner recovery chamber within the cleaning unit 4.

The image forming apparatus may be an apparatus containing a plurality of developing units of the type described above. The image forming apparatus may be such that a plurality of toner images that are different from each other in color and have been successively prepared by the plurality of developing units are successively transferred onto a recording medium and the recording medium is then transferred onto a fixation mechanism where the toners are fixed by heat or the like. Alternatively, the image forming apparatus may be such that a plurality of toner images prepared in the same manner as described above are successively once transferred onto an intermediate transfer medium and are transferred at a time on a recording medium such as paper and the image is fixed in the same manner as described above.

The charging unit 3 is preferably a charging unit that is provided in contact with or near the surface of the image bearing member, and a discharge wire was used as the charging unit 3. According to this charging unit, as compared with a corona discharge device called corotron and scorotron, the amount of ozone generated during the charging can be significantly reduced.

(Process Cartridge)

A process cartridge used in the present invention contains at least an image bearing member, the protective layer forming unit according to the present invention and, if necessary, other units such as a charging unit, an exposure unit, a developing unit, a transferring unit, a cleaning unit, and a discharging unit.

The process cartridge can be detachably provided in various image forming apparatus bodies and is preferably detachably provided in the image forming apparatus body according to the present invention.

Figure 10:
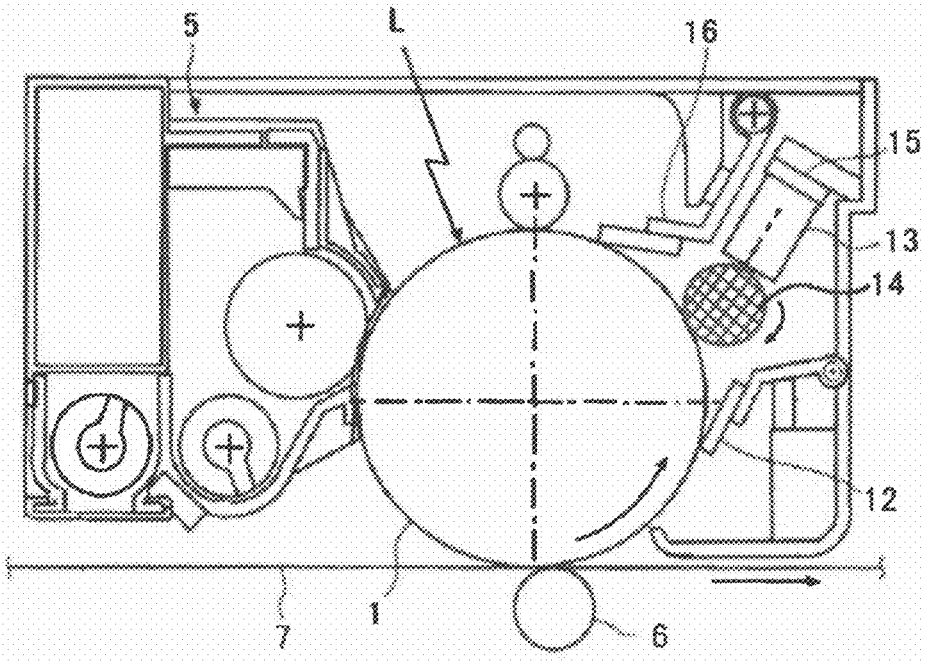
FIG. 10 is a schematic cross-sectional view of an example of a process cartridge used in the present invention.

FIG. 10 is a schematic cross-sectional view of one example of the process cartridge.

In the process cartridge, a protective layer forming apparatus 2 that is provided to face a photoconductor drum 1 which is an image bearing member contains a protective agent block 13, a protective agent feeding member 14, a pressure applying member 15, a protective layer forming member 16 and the like.

After the transferring step, the image bearing member has a surface on which, for example, a partially deteriorated protective agent block and a toner ingredient stay. The residue on the surface is removed by a cleaning unit 12 to clean the surface.

In FIG. 10, the cleaning unit 12 is abutted at an angle similar to the so-called counter type (leading type).

A protective agent is fed from the protective agent feeding member 14 to the surface of the image bearing member, from which the toner that stays on the surface, or the deteriorated protective agent block have been removed by the cleaning unit 12, and a film-like protective layer is formed by the protective layer forming member 16.

The image bearing member with the protective layer formed thereon is electrified and is exposed to light L such as laser beams to form a latent electrostatic image. The latent electrostatic image is developed with a developing unit 5 to form a visible image which is then transferred onto a recording medium 7, for example, by a transferring unit 6 located outside the process cartridge.

EXAMPLES

The present invention will be described with reference to the following Examples. However, it should be noted that the present invention is not limited to these Examples.

Production Example 1

Production of Protective Agent Block 1

A mixture of 90 parts by mass of zinc stearate (GF-200, manufactured by NOF CORPORATION) with 10 parts by mass of boron nitride (NX5, manufactured by Momentive Performance Materials Inc.) was placed in a predetermined mold. The mixture was leveled, was then compression-molded under conditions of a pressure of 130 kN and a compression time of 10 sec to obtain a square columnar protective agent block 1 having a heightwise length of 10 mm, a transverse length of 8 mm, and a longitudinal length of 320 mm.

Production Example 2

Production of Protective Agent Block 2

A mixture of 90 parts by mass of zinc stearate (GF-200, manufactured by NOF CORPORATION) with 10 parts by mass of talc (PFI talc, manufactured by MIYOSHI KASEI INC) was placed in a predetermined mold. The mixture was leveled, was then compression-molded under conditions of a pressure of 130 kN and a compression time of 10 sec to obtain a square columnar protective agent block 2 having a heightwise length of 10 mm, a transverse length of 8 mm, and a longitudinal length of 320 mm.

Production Example 3

Production of Protective Agent Block 3

A mixture of 90 parts by mass of zinc stearate (GF-200, manufactured by NOF CORPORATION) with 10 parts by mass of mica (SA mica, manufactured by MIYOSHI KASEI INC) was placed in a predetermined mold. The mixture was leveled, was then compression-molded under conditions of a pressure of 130 kN and a compression time of 10 sec to obtain a square columnar protective agent block 3 having a heightwise length of 10 mm, a transverse length of 8 mm, and a longitudinal length of 320 mm.

Production Example 4

Production of Protective Agent Block 4

Zinc stearate (GF-200, manufactured by NOF CORPORATION) was placed in a predetermined mold. It was leveled, was then compression-molded under conditions of a pressure of 130 kN and a compression time of 10 sec to obtain a square columnar protective agent block 4 having a heightwise length of 10 mm, a transverse length of 8 mm, and a longitudinal length of 320 mm.

Production Example 5

Production of Protective Agent Block 5

A mixture of 90 parts by mass of zinc stearate (GF-200, manufactured by NOF CORPORATION) with 10 parts by mass of boron nitride (NX5, manufactured by Momentive Performance Materials Inc.) was melted and was then placed in a predetermined mold to obtain a protective agent block 5.

The protective agent block 5 thus obtained had a square columnar shape with a heightwise length of 10 mm, a transverse length of 8 mm, and a longitudinal length of 320 mm.

Production Example 6

Production of Protective Agent Block 6

Zinc stearate (GF-200, manufactured by NOF CORPORATION) was melted and was then placed in a predetermined mold to obtain a protective agent block 6.

The protective agent block 6 thus obtained had a square columnar shape with a heightwise length of 10 mm, a transverse length of 8 mm, and a longitudinal length of 320 mm.

TABLE 1

| | | Molding method | Metal salt of fatty acid | Inorganic lubricating agent |
|---|---|---|---|---|
| Production Example 1 | Protective agent block 1 | Compression molding | Zinc stearate | Boron nitride |
| Production Example 2 | Protective agent block 2 | Compression molding | Zinc stearate | Talc |
| Production Example 3 | Protective agent block 3 | Compression molding | Zinc stearate | Mica |
| Production Example 4 | Protective agent block 4 | Compression molding | Zinc stearate | — |
| Production Example 5 | Protective agent block 5 | Melt molding | Zinc stearate | Boron nitride |
| Production Example 6 | Protective agent block 6 | Melt molding | Zinc stearate | — |

Example 1

Production of Protective Agent Feeding Member 1

Polyurethane foam (Everlight SF QZK-70, manufactured by Bridgestone Corporation) was cut into a predetermined size. Subsequently, a hole for the insertion of a core (average diameter 6 mm, length 365 mm, stainless steel) was formed in the cut polyurethane foam, and the core was inserted into the hole and was fixed. Thereafter, the polyurethane foam with the core inserted therein was taken off in a roller form with the core as an axis, and a foam layer formed of polyurethane foam was formed on the outer periphery of the core. While rotating the foam layer thus formed, a blade of a grinding machine was applied to the foam layer and was moved in a direction parallel to the axial direction to perform traverse grinding to roughen the surface of the foam layer and thus to produce a protective agent feeding member 1. The traverse grinding was performed at a traverse speed of 3,000 mm/min.

In the protective agent feeding member 1 thus obtained, the foam layer had an interconnecting cell structure and had an average thickness of 3 mm.

For the protective agent feeding member 1, the maximum height Ry of the surface of the foam layer, the standard deviation of the surface roughness of the foam layer, the number of cells of the foam layer, and the hardness of the foam layer were measured as follows. The results are shown in Table 2.

<Maximum Height Ry>

The maximum height Ry of the surface of the foam layer was measured according to JIS B 0601 (1994).

Figure 8:
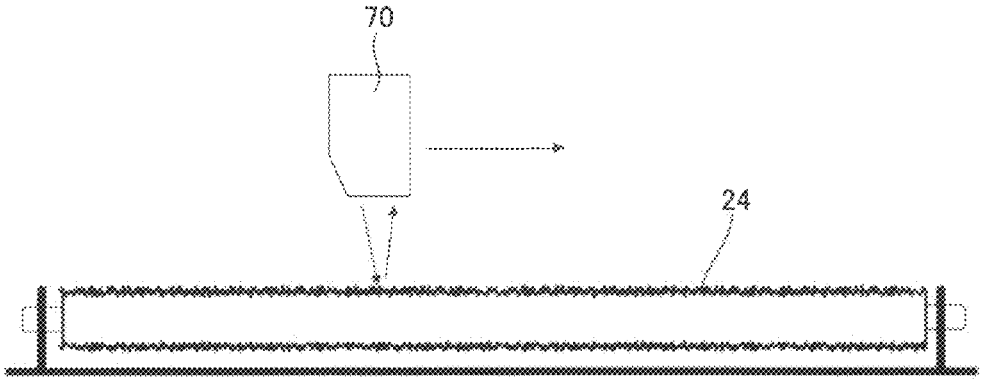
FIG. 8 is a diagram showing how to measure a maximum height Ry of the surface of a foam layer in a protective agent feeding member according to the present invention.

Specifically, as shown in FIG. 8, the surface profile of the foam layer 24 was measured with a laser displacement meter movable in an axial direction (HLC-105B, manufactured by SunX) 70 at intervals of 0.25 mm. The maximum height Ry was calculated from the measured values (see FIG. 2).

<Standard Deviation of Surface Roughness>

The standard deviation of the surface roughness of the foam layer was measured as follows.

RSV-1560IIC manufactured by Tokyo Opto-Electronics Co., Ltd. was used as a measuring apparatus.

A noncontact sizer LMG1505PII was used as a laser microgauge.

A straightness measuring mode was adopted as a measuring program.

The moving speed in an axial direction of the protective agent feeding member was 22 mm/sec, and data were acquired at intervals of 1.4 mm. The measurement was performed four times in total while rotating in a circumferential direction 90 degrees by 90 degrees. For each four-time measurement, the standard deviation was determined, and the data were averaged.

<Number of Cells>

On the surface of the foam layer, three places were arbitrarily selected respectively at a portion around each of both ends in an axial direction of the protective agent feeding member and a central portion. At each measuring place, two places were then additionally selected in a circumferential direction to determine nine measuring places in total. A photograph screen of each of the measuring places was observed with a microscope (Digital Microscope VHX-100, manufactured by KEYENCE CORPORATION). A line having a length corresponding to a plain scale of one inch (2.54 cm) was drawn at the centre of the photograph screen. The number of cells within the line was counted, and the average of the data on the nine places was determined. In this case, a cell that is even slightly in contact with the one-inch (2.54 cm) line was counted as the cell located within the line.

<Hardness>

The hardness was determined by measuring the hardness (unit: N) at any three points on the surface of the foam layer according to JIS K 6400 and averaging the measured values.

<Continuous Passage Test of 1,000 Sheets of Original that is of Size A4 and has Percentage Image Area of 100%>

Instead of the zinc stearate block used in a digital full-color complex machine (Imagio MP C5000, manufactured by Ricoh Co., Ltd.), a protective agent block 1 was provided in an image forming part in the complex machine. Further, a protective agent feeding member 1 was provided instead of a brush roller used in the complex machine.

A standard toner for Imagio MP C5000 manufactured by Ricoh Co., Ltd. was used as a toner.

The toner had an average circularity of 0.965 and a toner mass average particle diameter (D4) to number average particle diameter (D1) ratio, D4/D1, of 1.14.

In the modified complex machine, a protective layer forming apparatus had a construction as shown in FIG. 7.

In the protective layer forming apparatus, when the protective agent feeding member 1 was abutted against an image bearing member, the level of biting of the protective agent feeding member 1 was 1.0 mm. The level of biting is the maximum deformation level of the foam layer in the thickness-wise direction of the foam layer upon abutting of a protective agent feeding member against an image bearing member.

A technique described in Japanese Patent Application Laid-Open (JP-A) No. 2007-293740 was adopted as a pressing force applying member to be abutted against the protective agent feeding member by pressing the protective agent block in the digital full-color complex machine (Imagio MP C5000, manufactured by Ricoh Co., Ltd.) used in the Examples to allow the protective agent block to be pressed at a pressure that is constant and is equalized in the longitudinal direction even with the elapse of time. The pressure was 5N in terms of the pressure applied to the protective agent block.

<<Minimum Consumption of Protective Agent when Filming (Film Formation) on Image Bearing Member does not Occur>>

In the continuous passage test of 1,000 sheets, the load of a spring in a pressing force applying member was gradually reduced to reduce a protective agent consumption (g/km), and the minimum protective agent consumption (g/km) at which filming did not occur was determined.

The determined minimum protective agent consumption (g/km) when the filming did not occur was evaluated according to the following criteria. The results are shown in Table 2.

[Evaluation Criteria]

I: The minimum consumption of the protective agent is less than 0.16 g/km.

II: The minimum consumption of the protective agent is 0.16 g/km or more but less than 0.18 g/km.

III: The minimum consumption of the protective agent is 0.18 g/km or more.

<<Contamination of Charging Unit>>

Contamination of charging unit after continuous passage of 1,000 sheets was visually observed and was evaluated according to the following criteria. The results are shown in Table 2.

[Evaluation Criteria]

I: Contamination does not substantially occur, and anti-contamination is good.

II: Contamination occurs but is on an acceptable level.

III: Contamination significantly occurs and is on an unacceptable level.

<<Contamination of Photoconductor by Filming>>

The contamination of the image bearing member by filming after the continuous passage of 1,000 sheets was visually observed and was then evaluated according to the following criteria. The results are shown in Table 2.

[Evaluation Criteria]

A: Contamination does not occur at all, and anti-contamination is good.

B: Contamination does not substantially occur, and anti-contamination is good.

C: Contamination occurs but is on an acceptable level.

D: Contamination significantly occurs on an unacceptable level.

Example 2

Production of Protective Agent Feeding Member 2-1

A protective agent feeding member 2-1 was produced in the same manner as in Example 1, except that the traverse speed was changed from 3,000 mm/min to 2,500 mm/min in the traverse grinding to roughen the surface of the foam layer.

The foam layer in the protective agent feeding member 2-1 thus obtained had a structure containing interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 2-1 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 2-1. The results are shown in Table 2.

Example 3

Production of Protective Agent Feeding Member 3

A protective agent feeding member 3 was produced in the same manner as in Example 1, except that the traverse speed was changed from 3,000 mm/min to 2,000 mm/min in the traverse grinding to roughen the surface of the foam layer.

The foam layer in the protective agent feeding member 3 thus obtained had a structure containing interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 3 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 3. The results are shown in Table 2.

Example 4

Production of Protective Agent Feeding Member 4

A protective agent feeding member 4 was produced in the same manner as in Example 1, except that the traverse speed was changed from 3,000 mm/min to 1,000 mm/min in the traverse grinding to roughen the surface of the foam layer.

The foam layer in the protective agent feeding member 4 thus obtained had a structure containing interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 4 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 4. The results are shown in Table 2.

Example 5

Production of Protective Agent Feeding Member 2-2

A protective agent feeding member 2-2 was produced in the same manner as in Example 1, except that the traverse speed was changed from 3,000 mm/min to 2,500 mm/min in the traverse grinding to roughen the surface of the foam layer.

The foam layer in the protective agent feeding member 2-2 thus obtained had a structure containing interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 2-2 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 2-2 and the protective agent block 1 was changed to the protective agent block 5. The results are shown in Table 2.

Example 6

Production of Protective Agent Feeding Member 5

A protective agent feeding member 5 was produced in the same manner as in Example 4, except that the polyurethane foam (Everlight SF QZK-70, manufactured by Bridgestone Corporation) was changed to polyurethane foam (Everlight SF EPT-50, manufactured by Bridgestone Corporation).

The foam layer in the protective agent feeding member 5 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 5 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 5. The results are shown in Table 2.

Example 7

Production of Protective Agent Feeding Member 6

A protective agent feeding member 6 was produced in the same manner as in Example 2, except that the polyurethane foam (Everlight SF QZK-70, manufactured by Bridgestone Corporation) was changed to polyurethane foam (Everlight SF HR-30, manufactured by Bridgestone Corporation).

The foam layer in the protective agent feeding member 6 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 6 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 6. The results are shown in Table 2.

Example 8

Production of Protective Agent Feeding Member 7

A protective agent feeding member 7 was produced in the same manner as in Example 2, except that the polyurethane foam (Everlight SF QZK-70, manufactured by Bridgestone Corporation) was changed to polyurethane foam (Everlight SF QZK-70, manufactured by Bridgestone Corporation) having a three-fold foam compression strength.

The foam layer in the protective agent feeding member 7 thus obtained was had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 7 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 7. The results are shown in Table 2.

Example 9

Production of Protective Agent Feeding Member 2-3

A protective agent feeding member 2-3 was produced in the same manner as in Example 1, except that the traverse speed was changed from 3,000 mm/min to 2,500 mm/min in the traverse grinding to roughen the surface of the foam layer.

The foam layer in the protective agent feeding member 2-3 thus obtained was had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 2-3 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 2-3, and the protective agent block 1 was changed to the protective agent block 4. The results are shown in Table 2.

Example 10

Production of Protective Agent Feeding Member 2-4

A protective agent feeding member 2-4 was produced in the same manner as in Example 1, except that the traverse speed was changed from 3,000 mm/min to 2,500 mm/min in the traverse grinding to roughen the surface of the foam layer.

The foam layer in the protective agent feeding member 2-4 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 2-4 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 2-4, and the protective agent block 1 was changed to the protective agent block 2. The results are shown in Table 2.

Example 11

Production of Protective Agent Feeding Member 2-5

A protective agent feeding member 2-5 was produced in the same manner as in Example 1, except that the traverse speed was changed from 3,000 mm/min to 2,500 mm/min in the traverse grinding to roughen the surface of the foam layer.

The foam layer in the protective agent feeding member 2-5 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 2-5 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 2-5, and the protective agent block 1 was changed to the protective agent block 3. The results are shown in Table 2.

Example 12

Production of Protective Agent Feeding Member 2-6

A protective agent feeding member 2-6 was produced in the same manner as in Example 1, except that the traverse speed was changed from 3,000 mm/min to 2,500 mm/min in the traverse grinding to roughen the surface of the foam layer.

The foam layer in the protective agent feeding member 2-6 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 2-6 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 2-6, and the protective agent block 1 was changed to the protective agent block 6. The results are shown in Table 2.

Comparative Example 1

Production of Protective Agent Feeding Member 8-1

A protective agent feeding member 8-1 was produced in the same manner as in Example 1, except that the traverse speed was changed from 3,000 mm/min to 500 mm/min in the traverse grinding.

The foam layer in the protective agent feeding member 8-1 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 8-1 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 8-1. The results are shown in Table 2.

Comparative Example 2

Production of Protective Agent Feeding Member 8-2

A protective agent feeding member 8-2 was produced in the same manner as in Example 1, except that the traverse speed was changed from 3,000 mm/min to 500 mm/min.

The foam layer in the protective agent feeding member 8-2 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 8-2 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 8-2, and the protective agent block 1 was changed to the protective agent block 5. The results are shown in Table 2.

Comparative Example 3

Production of Protective Agent Feeding Member 9-1

A protective agent feeding member 9-1 was produced in the same manner as in Example 1, except that the traverse speed was changed from 3,000 mm/min to 4,500 mm/min.

The foam layer in the protective agent feeding member 9-1 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 9-1 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 9-1. The results are shown in Table 2.

Comparative Example 4

Production of Protective Agent Feeding Member 10

A protective agent feeding member 10 was produced in the same manner as in Example 1, except that the traverse speed was changed from 3,000 mm/min to 800 mm/min.

The foam layer in the protective agent feeding member 10 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 10 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 10. The results are shown in Table 2.

Comparative Example 5

Production of Protective Agent Feeding Member 8-3

A protective agent feeding member 8-3 was produced in the same manner as in Example 1, except that the traverse speed was changed from 3,000 mm/min to 500 mm/min, and that the polyurethane foam (Everlight SF QZK-70, manufactured by Bridgestone Corporation) was changed to polyurethane foam (Everlight SF QZK-70, manufactured by Bridgestone Corporation) having a three-fold foam compression strength.

The foam layer in the protective agent feeding member 8-3 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 8-3 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 8-3. The results are shown in Table 2.

Comparative Example 6

Production of Protective Agent Feeding Member 9-2

A protective agent feeding member 9-2 was produced in the same manner as in Example 1, except that the traverse speed was changed from 3,000 mm/min to 4,500 mm/min, and that the polyurethane foam (Everlight SF QZK-70, manufactured by Bridgestone Corporation) was changed to polyurethane foam (Everlight SF HR-30, manufactured by Bridgestone Corporation).

The foam layer in the protective agent feeding member 9-2 thus obtained had a structure having interconnected cells and had an average thickness of 3 mm.

The maximum height Ry of the surface of the foam layer, the standard deviation of the surface roughness of the foam layer, the number of cells in the foam layer, and the hardness of the foam layer were measured for the protective agent feeding member 9-2 in the same manner as in Example 1. The results are shown in Table 2.

Next, a continuous passage test of 1,000 sheets was carried out to evaluate various properties in the same manner as in Example 1, except that the protective agent feeding member 1 was changed to the protective agent feeding member 9-2. The results are shown in Table 2.

TABLE 2

| | | Foam layer | | | | |
|---|---|---|---|---|---|---|
| | Protective agent feeding member No. | Max. height Ry (μm) | Standard deviation of surface roughness (μm) | Traverse speed (mm/min) | Number of cells (cells/inch) | Hardness (N) |
| Ex. 1 | 1 | 912.1 | 0.301 | 3,000 | 70 | 150 |
| Ex. 2 | 2-1 | 787.7 | 0.112 | 2,500 | 70 | 150 |
| Ex. 3 | 3 | 643.1 | 0.069 | 2,000 | 70 | 150 |
| Ex. 4 | 4 | 400.5 | 0.034 | 1,000 | 70 | 150 |
| Ex. 5 | 2-2 | 730.2 | 0.088 | 2,500 | 70 | 150 |

TABLE 2-continued

| | | | | | | |
|---|---|---|---|---|---|---|
| Ex. 6 | 5 | 420.3 | 3.09 | 1,000 | 50 | 100 |
| Ex. 7 | 6 | 1,625.3 | 6.055 | 2,500 | 30 | 100 |
| Ex. 8 | 7 | 405.1 | 0.019 | 2,500 | 300 | 480 |
| Ex. 9 | 2-3 | 767.7 | 0.08 | 2,500 | 70 | 150 |
| Ex. 10 | 2-4 | 733.9 | 0.131 | 2,500 | 70 | 150 |
| Ex. 11 | 2-5 | 723.3 | 0.062 | 2,500 | 70 | 150 |
| Ex. 12 | 2-6 | 716.1 | 0.123 | 2,500 | 70 | 150 |
| Comp. Ex. 1 | 8-1 | 370.9 | 0.011 | 500 | 70 | 150 |
| Comp. Ex. 2 | 8-2 | 379.2 | 0.013 | 500 | 70 | 150 |
| Comp. Ex. 3 | 9-1 | 1,648.1 | 6.490 | 4,500 | 70 | 150 |
| Comp. Ex. 4 | 10 | 386.5 | 0.018 | 800 | 70 | 150 |
| Comp. Ex. 5 | 8-3 | 320.0 | 0.015 | 500 | 300 | 150 |
| Comp. Ex. 6 | 9-2 | 1,991.0 | 6.8 | 4,500 | 30 | 150 |

| | Protective agent block | | | |
|---|---|---|---|---|
| | | Materials | | |
| | No. | Metal salt of fatty acid | Inorganic lubricant | Molding method |
| Example 1 | 1 | ZnST | BN | Compression molding |
| Example 2 | 1 | ZnST | BN | Compression molding |
| Example 3 | 1 | ZnST | BN | Compression molding |
| Example 4 | 1 | ZnST | BN | Compression molding |
| Example 5 | 5 | ZnST | BN | Melt molding |
| Example 6 | 1 | ZnST | BN | Compression molding |
| Example 7 | 1 | ZnST | BN | Compression molding |
| Example 8 | 1 | ZnST | BN | Compression molding |
| Example 9 | 4 | ZnST | — | Compression molding |
| Example 10 | 2 | ZnST | Talc | Compression molding |
| Example 11 | 3 | ZnST | Mica | Compression molding |
| Example 12 | 6 | ZnST | — | Melt molding |
| Comparative Example 1 | 1 | ZnST | BN | Compression molding |
| Comparative Example 2 | 5 | ZnST | BN | Melt molding |
| Comparative Example 3 | 1 | ZnST | BN | Compression molding |
| Comparative Example 4 | 1 | ZnST | BN | Compression molding |
| Comparative Example 5 | 1 | ZnST | BN | Compression molding |
| Comparative Example 6 | 1 | ZnST | BN | Compression molding |

| | Evaluation | | | |
|---|---|---|---|---|
| | Minimum consumption of protective agent when filming did not occur (g/km) | Evaluation of minimum consumption of protective agent | Communication of charging unit | Contamination of photoconductor by filming |
| Example 1 | 0.154 | I | I | A |
| Example 2 | 0.131 | I | I | A |
| Example 3 | 0.145 | I | I | A |
| Example 4 | 0.171 | II | I | A |
| Example 5 | 0.153 | I | I | B |
| Example 6 | 0.155 | I | I | B |
| Example 7 | 0.178 | II | I | C |
| Example 8 | 0.169 | II | I | C |
| Example 9 | 0.132 | I | II | A |

TABLE 2-continued

| | | | | |
|---|---|---|---|---|
| Example 10 | 0.139 | I | I | A |
| Example 11 | 0.145 | I | I | A |
| Example 12 | 0.145 | I | II | A |
| Comparative Example 1 | 0.205 | III | I | D |
| Comparative Example 2 | 0.209 | III | I | D |
| Comparative Example 3 | 0.242 | III | I | D |
| Comparative Example 4 | 0.189 | III | I | D |
| Comparative Example 5 | 0.257 | III | I | D |
| Comparative Example 6 | 0.271 | III | I | D |

In the table, "ZnST" represents zinc stearate, and "BN" represents boron nitride.

In Examples 1 to 12, flying of powder of the protective agent did not substantially occur. The amount of the protective agent used was smaller than that when the conventional brush roller was used as the protective agent feeding member.

Further, in Examples 1 to 12, the contact area between the protective agent feeding member and the protective agent block was reduced by the roughening of the surface of the foam layer, and, even under pressurized conditions in an actually used range, the protective agent feeding member could satisfactorily shave off the protective agent block. Further, by virtue of the presence of convexes, the foam layer is significantly flexed, and, thus, a large amount of the protective agent could be fed to an image bearing member. Thus, a necessary amount of the protective agent could be fed to the image bearing member to suppress filming of the image bearing member.

On the other hand, as in Comparative Example 5, when convexes are evenly formed on the surface of the foam layer and the standard deviation of the surface roughness of the foam layer is very small, the adhesion between the image bearing member and the roller surface is so high that large stress is disadvantageously applied to the image bearing member. Therefore, the protective agent that has been once coated onto the image bearing member is again shaved off (disadvantageously recovered). As a result, the image bearing member cannot be protected, and, thus, filming disadvantageously occurs.

Further, as in Comparative Example 6, when the convex part on the surface of the foam layer is large and the standard deviation of the surface roughness of the foam layer is very large, the adhesion between the image bearing member and the roller surface is so low that the shaved protective agent cannot be fed to the image bearing member.

The embodiments of the present invention are as follows:

<1> A protective agent feeding member containing:

a core; and a foam layer provided on an outer periphery of the core, wherein the protective agent feeding member is in the shape of a roller, and wherein the foam layer has a roughened surface and has a maximum height Ry of 400 μm to 1,630 μm.

<2> The protective agent feeding member according to <1>, wherein the foam layer has a surface roughness, the standard deviation of which is 0.02 μm to 6 μm.

<3> The protective agent feeding member according to any of <1> or <2>, wherein the foam layer contains polyurethane foam.

<4> The protective agent feeding member according to any one of <1> to <3>, wherein the foam layer is a foam layer containing interconnecting cells.

<5> The protective agent feeding member according to any one of <1> to <4>, wherein the foam layer has 20 cells/2.54 cm to 300 cells/2.54 cm and has a hardness of 40 N to 430 N.

<6> A protective layer forming apparatus containing:

a protective agent block; and the protective agent feeding member as defined in any one of <1> to <5>.

<7> The protective layer forming apparatus according to <6>, wherein the protective agent block contains a metal salt of fatty acid and an inorganic lubricating agent.

<8> The protective layer forming apparatus according to <7>, wherein the metal salt of fatty acid contains at least zinc stearate.

<9> The protective layer forming apparatus according to any of <7> or <8>, wherein the inorganic lubricating agent contains at least one material selected from the group consisting of talc, mica, and boron nitride.

<10> An image forming apparatus containing:

an image bearing member;

a charging unit configured to charge a surface of the image bearing member;

an exposure unit configured to expose the charged surface of the image bearing member to light to form a latent electrostatic image;

a developing unit configured to develop the latent electrostatic image with a toner to form a visible image;

a transferring unit configured to transfer the formed visible image onto a recording medium;

a fixing unit configured to fix the transferred image onto the recording medium;

a cleaning unit configured to remove the residual toner on the surface of the image bearing member; and a protective layer forming unit configured to apply a protective agent on the surface of the image bearing member to form a protective layer, wherein the protective layer forming unit is the protective layer forming apparatus as defined in any one of <6> to <9>.

In a roller-shaped protective agent feeding member having a foam layer, the protective agent feeding member according to the present invention does not substantially cause flying of powder of the protective agent produced by sliding or friction, can eliminate the need to increase the consumption of the protective agent, can prevent filming, and, thus, is suitable, for example, for electrophotographic image forming methods, image forming apparatuses, and process cartridges.

What is claimed is:

1. A protective agent feeding member comprising:
a core; and
a foam layer provided on an outer periphery of the core,
wherein the protective agent feeding member is in the shape of a roller, and
wherein the foam layer has a roughened surface and has a maximum height Ry of 400 μm to 1,630 μm.

2. The protective agent feeding member according to claim 1, wherein the roughened surface, the standard deviation of which is 0.02 μm to 6 μm.

3. The protective agent feeding member according to claim 1, wherein the foam layer contains polyurethane foam.

4. The protective agent feeding member according to claim 1, wherein the foam layer containing interconnecting cells.

5. The protective agent feeding member according to claim 1, wherein the foam layer has 20 cells/2.54 cm to 300 cells/2.54 cm and has a hardness of 40 N to 430 N.

6. A protective layer forming apparatus comprising:
a protective agent block; and
a protective agent feeding member,
wherein the protective agent feeding member contains:
a core; and
a foam layer provided on an outer periphery of the core,
wherein the protective agent feeding member is in the shape of a roller, and
wherein the foam layer has a roughened surface and has a maximum height Ry of 400 μm to 1,630 μm.

7. The protective layer forming apparatus according to claim 6, wherein the protective agent block contains a metal salt of fatty acid and an inorganic lubricating agent.

8. The protective layer forming apparatus according to claim 7, wherein the metal salt of fatty acid contains at least zinc stearate.

9. The protective layer forming apparatus according to claim 7, wherein the inorganic lubricating agent contains at least one material selected from the group consisting of talc, mica, and boron nitride.

10. An image forming apparatus comprising:
an image bearing member;
a charging unit configured to charge a surface of the image bearing member;
an exposure unit configured to expose the charged surface of the image bearing member to light to form a latent electrostatic image;
a developing unit configured to develop the latent electrostatic image with a toner to form a visible image;
a transferring unit configured to transfer the formed visible image onto a recording medium;
a fixing unit configured to fix the transferred image onto the recording medium;
a cleaning unit configured to remove the residual toner on the surface of the image bearing member; and
a protective layer forming unit configured to apply a protective agent on the surface of the image bearing member to form a protective layer,
wherein the protective layer forming unit contains:
a protective agent block; and
a protective agent feeding member,
wherein the protective agent feeding member contains:
a core; and
a foam layer provided on an outer periphery of the core,
wherein the protective agent feeding member is in the shape of a roller, and
wherein the foam layer has a roughened surface and has a maximum height Ry of 400 μm to 1,630 μm.

* * * * *